US011454083B2

(12) United States Patent
Asthana et al.

(10) Patent No.: US 11,454,083 B2
(45) Date of Patent: Sep. 27, 2022

(54) INTERVAL CONTROL VALVE INCLUDING AN EXPANDING METAL SEALED AND ANCHORED JOINTS

(71) Applicant: Halliburton Energy Services, Inc., Houston, TX (US)

(72) Inventors: Pranay Asthana, Carrollton, TX (US); Christian Alexander Jelly, Carrollton, TX (US); David Joe Steele, Carrollton, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 119 days.

(21) Appl. No.: 17/137,683

(22) Filed: Dec. 30, 2020

(65) Prior Publication Data

US 2022/0205336 A1 Jun. 30, 2022

(51) Int. Cl.
*E21B 33/12* (2006.01)

(52) U.S. Cl.
CPC ..... *E21B 33/1212* (2013.01); *E21B 2200/06* (2020.05)

(58) Field of Classification Search
CPC ... E21B 33/1212; E21B 34/14; E21B 2200/06
See application file for complete search history.

(56) References Cited

U.S. PATENT DOCUMENTS

| | | | | |
|---|---|---|---|---|
| 9,133,693 | B2 * | 9/2015 | Wasa Tverlid | E21B 43/106 |
| 2010/0225107 | A1 | 9/2010 | Tverlid | |
| 2014/0284058 | A1 * | 9/2014 | Watson | E21B 43/26 166/308.1 |
| 2015/0275587 | A1 | 10/2015 | Wolf et al. | |
| 2017/0107794 | A1 | 4/2017 | Steele | |
| 2021/0189830 | A1 * | 6/2021 | Greci | E21B 43/103 |

FOREIGN PATENT DOCUMENTS

| | | | |
|---|---|---|---|
| EP | 2501890 | B1 | 7/2014 |
| EP | 2447466 | B1 | 10/2018 |
| WO | 2016171666 | A1 | 10/2016 |
| WO | 2019094044 | A1 | 5/2019 |

* cited by examiner

*Primary Examiner* — Michael R Wills, III
(74) *Attorney, Agent, or Firm* — Scott Richardson; Parker Justiss, P.C.

(57) ABSTRACT

Provided is an interval control valve. The interval control valve, in one aspect, includes a tubular housing, the tubular housing having one or more openings extending there through, and a sliding sleeve positioned within the tubular, the sliding sleeve configured to move between a closed position closing a fluid path between the one or more opening and an interior of the tubular housing, and an open position opening the fluid path between the one or more openings and the interior of the tubular housing. The interval control valve according to this aspect additionally includes a tubular overlapping with the sliding sleeve, the sliding sleeve and the tubular defining an overlapping space, and an expanded metal joint located in at least a portion of the overlapping space, the expanded metal joint comprising a metal that has expanded in response to hydrolysis.

21 Claims, 28 Drawing Sheets

200
M2
M1
$C_L$
$L_1$
$L_2$
260

200
M2
M1
$C_L$
$D_o$
250
$d_1$
$d_2$
$t_1$
$t_2$

200
M2
M1
$C_L$
220
240
230
210

300
M2
M1
360
$C_L$

300
M2
M1
350
$C_L$

300
M2
M1
220
340
230
210
$C_L$

400
M2
M1
470
460
$C_L$ 220
230
440
210

450

500
M2
M1
560
$C_L$

500
M2
M1
550
$C_L$

500
M2
M1
220
540
530
210
$C_L$

600
M2
M1
660
670
$C_L$

600
M2
M1
650
670
$C_L$

600
M2
M1
220
640
670
530
210
$C_L$

700
M2
M1
360
$C_L$

700
M2
M1
350
$C_L$

700
M2
M1
220
340
230
210
$C_L$

800
M2
M1
360
870
$C_L$

800
M2
M1
350
870
$C_L$

800
M2
M1
220
340
870
230
210
$C_L$

900
M2
M1
$C_L$
260

900
M2
M1
$C_L$
250

900
M2
M1
$C_L$
220
910
240
230
210

M2
M1

1000
M2
M1
$C_L$
1060

1000
M2
M1
$C_L$
1050

1000
M2
M1
$C_L$
220
1025
1040
1030
1015
210

1100
M2
M1
1060
$C_L$

1100
M2
M1
1050
$C_L$

1100
M2
M1
1040
1030
1015
1125
220
210
$C_L$

1200
M2
M1
$C_L$
1060

1200
M2
M1
$C_L$
1050

1200
M2
M1
$C_L$
220
1225
1040
1030
1015
210

1300
M2
M1
1060
1370
$C_L$
1300
M2
M1
1040
1030
1015
1225
1370
220
210
$C_L$
1300
M2
M1
1050
1370
$C_L$
1300
M2
M1

1400
M2
M1
1060
$C_L$

1400
M2
M1
1050
$C_L$

1400
M2
M1
1040
1030
220
1125
1415
210
$C_L$

1500
M1
M2
1560
$C_L$

1500
M1
M2
1550
$C_L$

1500
M1
M2
1510
1530
1535
1540
1520
$C_L$ 1600
1620
M2
1630
1640
1610
M1
$C_L$

M2
M1
$C_L$

1600
M2
1650
M1
$C_L$
M2
M1

INTERVAL CONTROL VALVE INCLUDING AN EXPANDING METAL SEALED AND ANCHORED JOINTS

BACKGROUND

Traditional joints that perform simultaneous anchoring and sealing between two different parts may be achieved by using a combination of geometric mechanical joining methods, and sealing elements or inserts (e.g., elastomeric/plastic/metal). For example, geometric mechanical joining methods including non-sealing threads, snap rings, collets, Ratch Latch™, lock rings, bolting/riveting and other type of latching methods are often used. In other instances, simultaneous sealing and anchoring maybe achieved by using special sealing threads, such as premium threads or torqued connections, but typically only on round tubular geometries. Other traditional methods of joining to enable simultaneous anchoring and sealing include friction/interference/shrink fits, swaging, welding/brazing and similar fusion methods.

Certain other non-traditional joints are also used to anchor and seal two different parts relative to one another. In certain instances, non-traditional shape memory alloys are used to form the anchor and seal. In other instances, non-traditional shrink rings are used to form the anchor and seal. The above methods (e.g., traditional and non-traditional alike), however, have tradeoffs between simplicity, cost or function. For example, some are limited by geometry, such as threads, which can only be applied on round tubular sections.

BRIEF DESCRIPTION

Reference is now made to the following descriptions taken in conjunction with the accompanying drawings, in which:

FIGS. 2A through 16C illustrate various different manufacturing states for a variety of junctions designed, manufactured and operated according to the disclosure;

DETAILED DESCRIPTION

Figure 1:
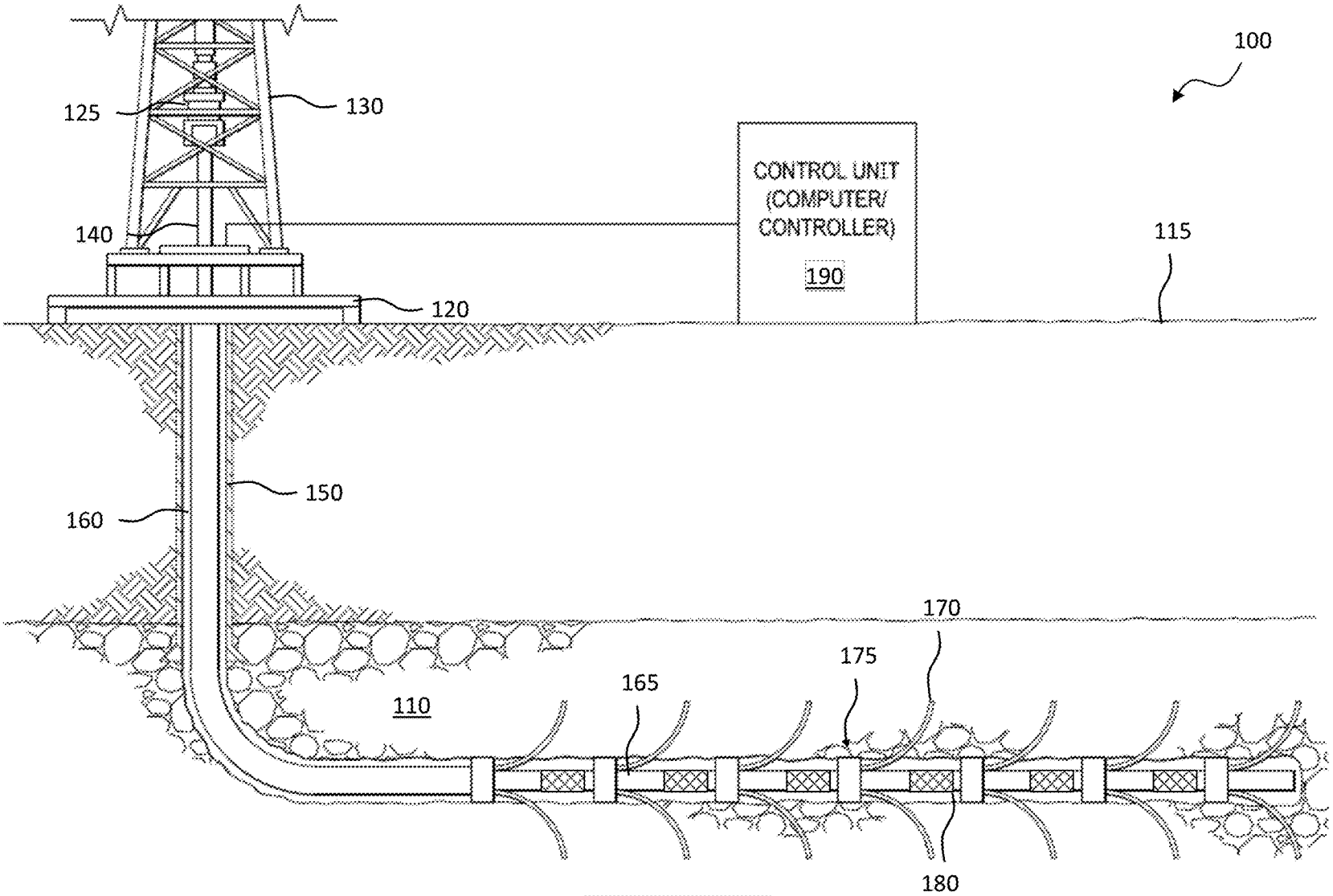
FIG. 1 illustrates a well system designed, manufactured, and operated according to one or more embodiments of the disclosure, and including a multilateral junction (e.g., y-block and two or more wellbore legs) and/or interval control valve (ICV) designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure describes a method for joining two or more similar and/or dissimilar materials using a novel expandable metal, as the base for the joint. As will be understood more fully below, the expandable metal begins as a metal, and after being subjected to an activation fluid, changes to a hard, fluid impermeable material. In certain embodiments, the hard, fluid impermeable material contains a certain amount of unreacted expandable metal, and thus may be self-healing and/or self-repairing.

The expandable metal has many different applications when joining two materials together, as well as provides certain advantages (e.g., incremental and radical advantages) over existing joints. For example, the expandable metal may be used to join any combination of two or more materials with various shapes and different interfacing/mating geometries, either as a primary joint and/or seal, or as a back-up method to currently available methods. Additionally, the expandable metal may have certain in-situ healing and/or/repairing properties, if for example degradation of the joint subsequently occurs. The expandable metal may be used to join round, circular but not round, or other mathematical geometries, all the same. Additionally, the expandable metal may be used along with threads, lock-rings, seal-rings, latches, etc., to attach and seal, while maintaining 360 degree contact. Moreover, the expandable metal may be used simply as an attachment method for structural load bearing, such as self-grown—snap rings, collets, ball profiled locks, dimpled surface locks, shear screws, shear rings, shear pins etc.

The expandable metal may additionally be modified to include various fillers, which could change one or more properties of the resulting joint. For example, the expandable metal could be modified to result in enhanced and/or performance calibrated material properties, such as: improved mechanical properties—shear strength, impact toughness, tensile strength, modulus of elasticity, elongation, thermal expansion etc.; improved electrical properties—conductivity, resistivity etc.; improved optical properties—refractive index, light transmissibility etc.; improved chemical properties—activation time, reaction rate etc.; as well as improved physical properties, magnetic properties and acoustical properties, to name a few.

Ultimately, expandable metal based joints (e.g., anchored and/or sealed joints) offer cost effective and relatively quick in-house solutions (applied at the time of assembly, activated prior to being placed downhole, active after being placed downhole, etc.) to joining two or more parts, in place of interference/shrink fits or welding/brazing, among others. Accordingly, the expandable metal based joints, could be used for one or more of the (e.g., non-limiting) following applications: 1) Intelligent completions, including shrink-fits for sliding sleeve carbide carriers for interval control valves, shrink-fits for deflectors and/or shroud adapters for water-injection in interval control valves, shrink-fits for Venturi flow meter mandrels, permanent monitoring gauges and pressure-temperature sensor weld joints, and gauge, sensors, modules and SOV weld joints in Imperium system; 2) Multilaterals—joining y-block junctions with their associated wellbore legs (e.g., D-tube, round, special profile cross section, double barrel, etc.); 3) Screens—various weldable parts and joints; 4) Sand Control—inflow control devices, autonomous inflow control devices, etc.; 5) any welded and/or brazed joint or profile, such as—weld cap, insert retentions, atmospheric chamber; and 6) any body internal design features in a design where a thread is used due to design constraints to create simultaneous seal and anchor.

Additionally, expanded metal joints may be used in certain applications where the heat required to weld or braze two surfaces together negatively affects the metallurgy of the surfaces. For instance, in certain high $H_2S$ or $CO_2$ applications, the features of the well must be manufactured according to National Association of Corrosion Engineers (NACE) standards. Unfortunately, the heat required to weld or braze the two surface together damage the corrosion resistance of the two surfaces, which means they no longer meet the NACE standard, and thus cannot be used. Nevertheless, the expanded metal joints function the same way as the welded or brazed joints, if not better, and do not require the extreme heat to form the same. Accordingly, the expanded metal joints could be used and still meet the NACE standard.

FIG. 1 illustrates a well system 100 designed, manufactured, and operated according to one or more embodiments of the disclosure, and including a multilateral junction 175 (e.g., y-block and two or more wellbore legs) and/or interval control valve (ICV) 180 designed, manufactured and operated according to one or more embodiments of the disclosure. In accordance with at least one embodiment, the multilateral junction 175 and/or ICV 180 could include expandable metal joints or expanded metal joints according to any of the embodiments, aspects, applications, variations, designs, etc. disclosed in the following paragraphs.

The well system 100 includes a platform 120 positioned over a subterranean formation 110 located below the earth's surface 115. The platform 120, in at least one embodiment, has a hoisting apparatus 125 and a derrick 130 for raising and lowering a downhole conveyance 140, such as a drill string, casing string, tubing string, coiled tubing, etc. Although a land-based oil and gas platform 120 is illustrated in FIG. 1, the scope of this disclosure is not thereby limited, and thus could potentially apply to offshore applications. The teachings of this disclosure may also be applied to other land-based multilateral wells different from that illustrated.

The well system 100 in one or more embodiments includes a main wellbore 150. The main wellbore 150, in the illustrated embodiment, includes tubing 160, 165, which may have differing tubular diameters. Extending from the main wellbore 150, in one or more embodiments, may be one or more lateral wellbores 170. Furthermore, a plurality of multilateral junctions 175 may be positioned at junctions between the main wellbore 150 and the lateral wellbores 170. Each multilateral junction 175 may comprise a y-block designed, manufactured or operated according to the disclosure. As discussed above, the multilateral junctions 175 may include expandable metal or expanded metal according to any of the embodiments, aspects, applications, variations, designs, etc. disclosed in the following paragraphs, including the use of expandable metal or expanded metal for the joints therein.

The well system 100 may additionally include one or more ICVs 180 positioned at various positions within the main wellbore 150 and/or one or more of the lateral wellbores 170. The ICVs 180 may comprise an ICV designed, manufactured or operated according to the disclosure. As discussed above, one or more of the ICVs 180 could include expandable metal or expanded metal according to any of the embodiments, aspects, applications, variations, designs, etc. disclosed in the following paragraphs, for example with respect to any of the joints within the ICVs 180. The well system 100 may additionally include a control unit 190. The control unit 190, in this embodiment, is operable to provide control to or received signals from, one or more downhole devices.

In certain embodiments, the multilateral junction 175 and/or ICV 180 may include one or more expanded metal joints (e.g., anchor, seal, or anchor and seal joints) that were formed with pre-expansion metal (e.g., metal configured to expand in response to hydrolysis) in accordance with one or more embodiments of the disclosure. After the pre-expansion metal has been subjected to an activation agent, the one or more joints would include expanded metal in accordance with one or more embodiments of the disclosure. In accordance with one or more embodiments of the disclosure, at least a portion of the expanded metal joint additionally includes residual unreacted expandable metal therein, and thus retains a self-healing and/or self-repairing aspect.

The expanded metal joint, in at least one embodiment, expands to generally fill the overlapping space between the two or more features that are being joined. The overlapping space in at least one embodiment includes the space created between opposing surfaces of the two or more features, regardless of the relative orientation (e.g. parallel with the longitudinal axis of the two or more features, perpendicular with the longitudinal axis of the two or more features, or angled relative to the longitudinal axis of the two or more features). The phrase generally fill, as that term is used herein, is intended to convey that at least 20 percent of the overlapping space is filled. In other embodiments, the expanded metal joint expands to substantially fill, and in yet other embodiments expands to excessively fill, the overlapping space between the two or more features that are being joined. The phrase substantially fill, as that term is used herein, is intended to convey that at least 50 percent of the overlapping space is filled, and the phrase excessively fill, as that term is used herein, is intended to convey that at least 75 percent of the overlapping space is filled.

The expanded metal joint in the overlapping space, in one or more embodiments, has a volume of no more than 25,000 $cm^3$. In yet another embodiment, the overlapping space has a volume of no more than 7,750 $cm^3$. In certain embodiments, the expanded metal joint has a volume ranging from about 31.5 $mm^3$ to about 5,813 $cm^3$. In yet another embodiment, the expanded metal joint has a volume ranging from about 4,282 $mm^3$ to about 96,700 $mm^3$. Nevertheless, the volume of the expanded metal joint should be designed to provide an adequate anchor and/or seal for the two or more features being joined (e.g., without overly expanding to the areas outside of the overlapping space), but otherwise is not limited to any specific values.

Again, in certain embodiments, the expanded metal joint includes residual unreacted expandable metal therein. For example, in certain embodiments the expanded metal joint is intentionally designed to include the residual unreacted expandable metal therein. The residual unreacted expandable metal has the benefit of allowing the expanded metal joint to self-heal if cracks or other anomalies subsequently arise. Nevertheless, other embodiments may exist wherein no residual unreacted expandable metal exists in the expanded metal joint.

The expandable metal, in some embodiments, may be described as expanding to a cement like material. In other words, the metal goes from metal to micron-scale particles and then these particles expand and lock together to, in essence, lock the expanded metal joint in place. The reaction may, in certain embodiments, occur in less than 24 hours in a reactive fluid and acceptable temperatures. Nevertheless, the time of reaction may vary depending on the reactive fluid, the expandable metal used, thickness of the expandable metal used, and the temperature.

In some embodiments, the reactive fluid may be a brine solution such as may be produced during well completion activities, and in other embodiments, the reactive fluid may be one of the additional solutions discussed herein. The metal, pre-expansion, is electrically conductive in certain embodiments. The metal may be machined to any specific size/shape, extruded, forged, cast, printed or other conventional ways to get the desired shape of a metal, as will be discussed in greater detail below. Metal, pre-expansion, in certain embodiments has a yield strength greater than about 8,000 psi, e.g., 8,000 psi+/−50%.

The hydrolysis of the metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reactions uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases.

In an embodiment, the metallic material used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. The metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The metal alloy can be constructed in a solid solution process where the elements are combined with molten metal or metal alloy. Alternatively, the metal alloy could be constructed with a powder metallurgy process. The metal can be cast, forged, extruded, sintered, welded, mill machined, lathe machined, stamped, eroded or a combination thereof.

Optionally, non-expanding components may be added to the starting metallic materials. For example, ceramic, elastomer, plastic, epoxy, glass, or non-reacting metal components can be embedded in the expanding metal or coated on the surface of the metal. Alternatively, the starting metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expanding metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for fully expanding. For example, the expandable metal may be formed into a single long member, multiple short members, rings, alternating steel and expandable rubber and expandable metal rings, among others.

Figures 2A, 2B, 2C:
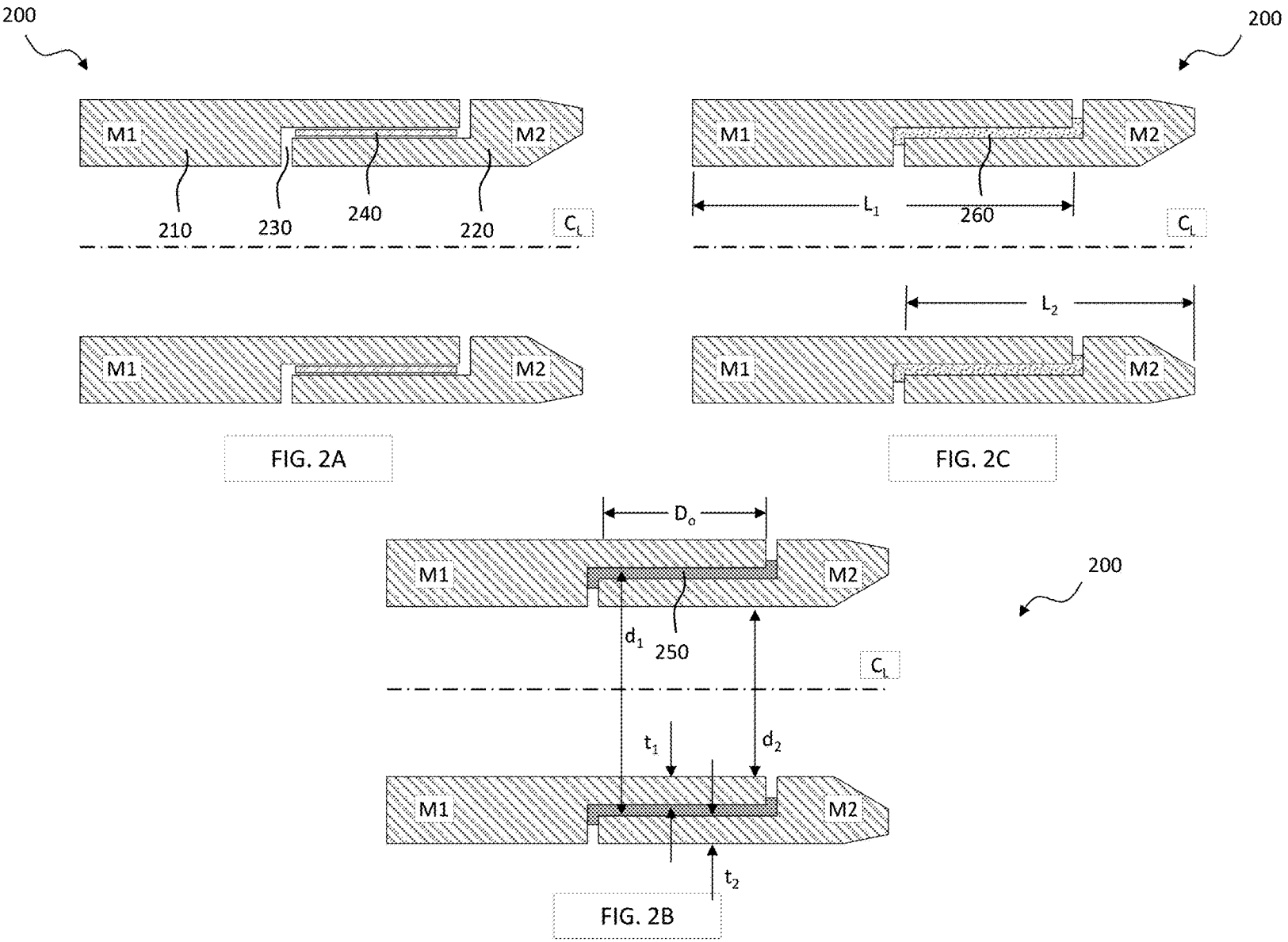

Turning to FIGS. 2A through 2C, depicted are various different manufacturing states for a junction 200 designed, manufactured and operated according to the disclosure. FIG. 2A illustrates the junction 200 pre-expansion, FIG. 2B illustrates the junction 200 post-expansion, and FIG. 2C illustrates the junction 200 post-expansion and containing residual unreacted expandable metal therein. The junction 200 of FIGS. 2A through 2C includes a first member 210 and second member 220. In accordance with one or more embodiments of the disclosure, the first member 210 comprises a first material (M1) and the second member 220 comprises a second material (M2). In certain embodiments, the first material (M1) and the second material (M2) are the same material, but in other embodiments the first material (M1) and the second material (M2) are different materials.

In the illustrated embodiment, and in accordance with the disclosure, the first member 210 and the second member 220 overlap one another. Depending on the design, the overlap may be face-to-face, end-to-end, but-to-but, or any other overlap, as well as combinations of the same. The first member 210 and the second member 220, in the illustrated embodiment, thus define an overlapping space 230. The overlapping space 230, in at least one or more embodiments, defines the type of junction. For example, in the embodiment of FIGS. 2A through 2C, the overlapping space 230 is a single step overlapping space, which would tend to form a single step joint, as further discussed below.

While not required, the first member 210 and the second member 220 are a first tubular and a second tubular in the embodiment discussed with regard to FIGS. 2A through 2C. Accordingly, the first member 210 and the second member 220 define a centerline (CO in the embodiments shown. In other embodiments, however, one or both of the first member 210 or the second member 220 are not tubulars. In at least one embodiment, the second member 220 is a collet being coupled to the first member 210.

In the illustrated embodiment, the first member 210 has a first wall thickness ($t_1$) proximate the overlapping space 230 and the second member 220 has a second wall thickness ($t_2$) proximate the overlapping space 230. In accordance with at least one embodiment, the first wall thickness ($t_1$) and the second wall thickness ($t_2$) are no more than 5.0 cm. Nevertheless, in at least one other embodiment, the first wall thickness ($t_1$) and the second wall thickness ($t_2$) are no more than 1.25 cm. Nevertheless, in at least yet another embodiment, the first wall thickness ($t_1$) and the second wall thickness ($t_2$) are between about 0.15 cm and about 0.635 cm. Nevertheless, in at least yet another embodiment, the first wall thickness ($t_1$) and the second wall thickness ($t_2$) are no more than 0.7 cm. Thus, in accordance with the embodiment shown, the first member 210 and the second member 220 are thin walled structures.

In the illustrated embodiment, the first member 210 has a first inside diameter ($d_1$) proximate the overlapping space 230 and the second member 220 has a second inside diameter ($d_2$) proximate the overlapping space 230. In the illustrated embodiment, the overlapping space 230 (and thus the resulting expanded metal joint) is positioned proximate an end of the first member 210 or second member 220. In accordance with at least one embodiment, the overlapping space 230 (and thus the resulting expanded metal joint) is positioned less than a distance ($D_p$) from the end of the first member 210 or second member 220. The distance ($D_p$), in one or more embodiments, is equal to or less than four times the first inside diameter ($d_1$). The distance ($D_p$), in one or more other embodiments, is equal to or less than two times the first inside diameter ($d_1$).

In the illustrated embodiment, the first member 210 and the second member 220 overlap by a distance ($D_o$). In at least one embodiment, the overlap distance ($D_o$) between the first member 210 and the second member 220 is less than 120 cm. In yet another embodiment, the overlap distance ($D_o$) between the first member 210 and the second member 220 is less than 40 cm. In yet another embodiment, the overlap distance ($D_o$) between the first member 210 and the second member 220 is less than 10 cm. Essentially, as the first member 210 and second member 220 are thin walled structures in the embodiments of FIGS. 2A through 2C, the overlap distance ($D_o$) is not significant.

In the illustrated embodiment, the first member 210 has a length ($L_1$) and the second member 220 has a length ($L_2$). In the illustrated embodiment, at least a portion of the overlapping space 230 (and thus the resulting expanded metal joint) is parallel with the length ($L_1$). Further to this embodiment, at least another portion of the overlapping space 230 (and thus the resulting expanded metal joint) is perpendicular with the length ($L_1$). As will be discussed below, other embodiments exist wherein at least a portion of the overlapping space 230 (and thus the resulting expanded metal joint) is angled relative to the length ($L_1$).

With reference to FIG. 2A, a pre-expansion joint 240 is located at least partially within the overlapping space 230. The pre-expansion joint 240, in accordance with one or more embodiments of the disclosure, comprises a metal configured to expand in response to hydrolysis. The pre-expansion joint 240, in the illustrated embodiment, may comprise any of the expandable metals discussed above, or any combination of the same. The pre-expansion joint 240 may have a variety of different lengths and thicknesses, for example depending on the amount of anchor, as well as whether it is desired for the pre-expansion joint 240 to act as a seal when subjected to activation fluid, and remain within the scope of the disclosure.

With reference to FIG. 2B, illustrated is the pre-expansion joint 240 illustrated in FIG. 2A after subjecting it to an activation fluid to expand the metal in the overlapping space 230, and thereby form an expanded metal joint 250. In the illustrated embodiment, the expanded metal joint 250 generally fills the overlapping space, as that term is defined above. In yet other embodiments, the expanded metal joint 250 substantially fills the overlapping space, as that term is defined above, or in yet other embodiments, the expanded metal joint 250 excessively fills the overlapping space, as that term is defined above.

Notwithstanding the foregoing, the expanded metal joint 250 may have a variety of different volumes and remain within the scope of the disclosure. Such volumes, as expected, are a function of the size of the overlapping space 230, the volume of the pre-expansion joint 240, and the composition of the pre-expansion joint 240, among other factors. Nevertheless, in at least one embodiment, the expanded metal joint 250 has a volume of no more than 25,000 $cm^3$. In yet another embodiment, the overlapping space has a volume of no more than 7,750 $cm^3$. In at least one other embodiment, the expanded metal joint 250 has a volume ranging from about 31.5 $mm^3$ to about 5,813 $cm^3$, and in yet another embodiment, the expanded metal joint 250 has a volume ranging from about 4,282 $mm^3$ to about 96,700 $mm^3$.

With reference to FIG. 2C, illustrated is the pre-expansion joint 240 illustrated in FIG. 2A after subjecting it to an activation fluid to expand the metal in the overlapping space 230, and thereby form an expanded metal joint 260 including residual unreacted expandable metal therein. In one embodiment, the expanded metal joint 260 includes at least 1% residual unreacted expandable metal therein. In yet another embodiment, the expanded metal joint 260 includes at least 3% residual unreacted expandable metal therein. In even yet another embodiment, the expanded metal joint 260 includes at least 10% residual unreacted expandable metal therein, and in certain embodiments at least 20% residual unreacted expandable metal therein.

Figures 3A, 3B, 3C:
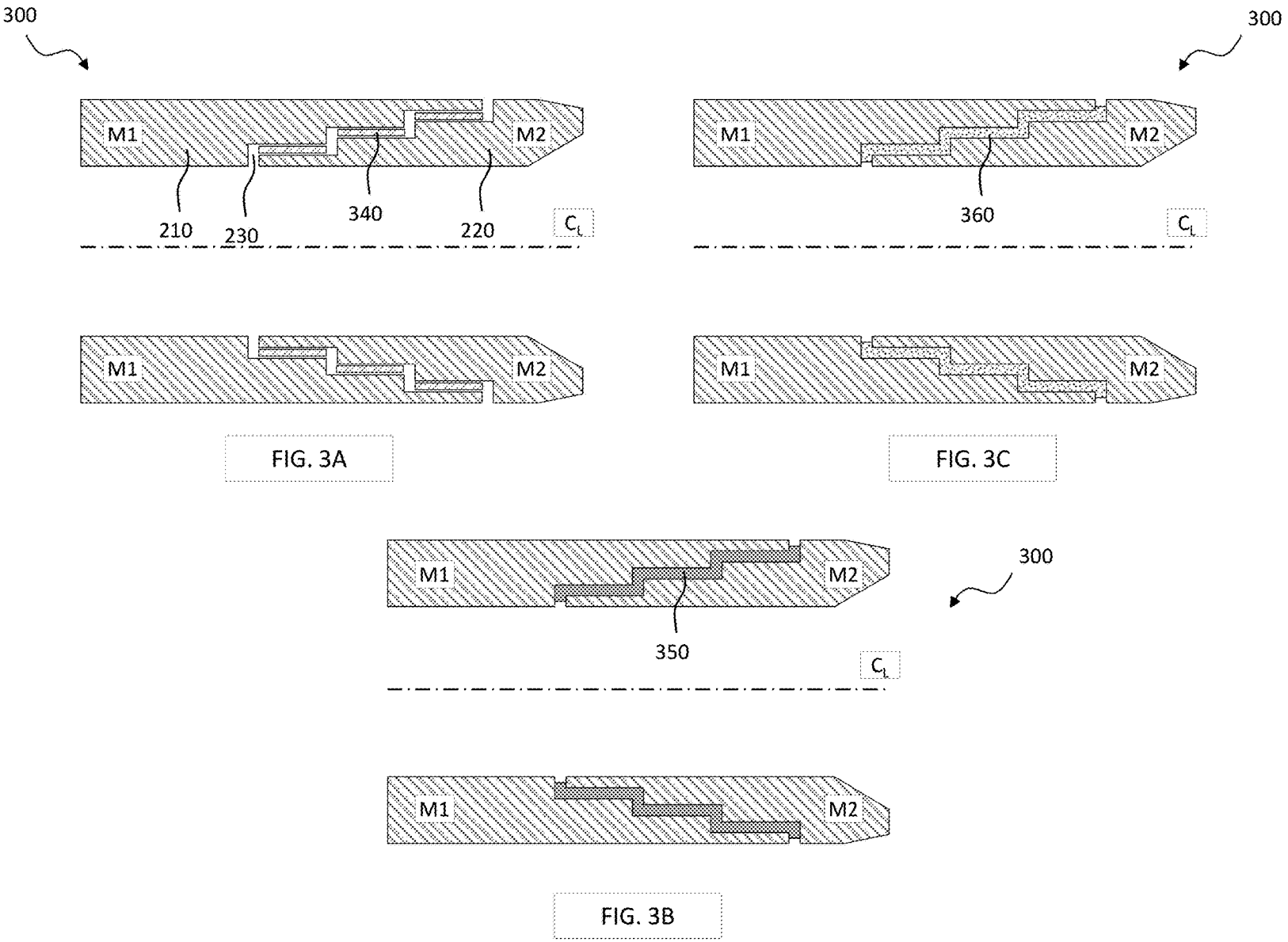

Turning now to FIGS. 3A through 3C, depicted are various different manufacturing states for a junction 300 designed, manufactured and operated according to an alternative embodiment of the disclosure. FIG. 3A illustrates the junction 300 pre-expansion, FIG. 3B illustrates the junction 300 post-expansion, and FIG. 3C illustrates the junction 300 post-expansion and containing residual unreacted expandable metal therein. The junction 300 of FIGS. 3A through 3C is similar in many respects to the junction 200 of FIGS. 2A through 2C. Accordingly, like reference numbers have been used to illustrate similar, if not identical, features. The junction 300 differs, for the most part, from the junction 200, in that the junction 300 is a multi-step junction. Accordingly, the junction 300 includes multiple pre-expansion metal joints 340, as well as multiple expanded metal joints 350, and/or multiple expanded metal joints 360 with residual unreacted expandable metal therein. In the illustrated embodiment of FIGS. 3A through 3C, the junction 300 includes three steps, each of which is parallel with the length ($L_1$). In yet other embodiments, the junction 300 might include only two steps, or alternatively more than three steps, depending on the design of the junction. Moreover, one or more of the steps could be angled relative to the length ($L_1$).

Figures 4A, 4B, 4C:
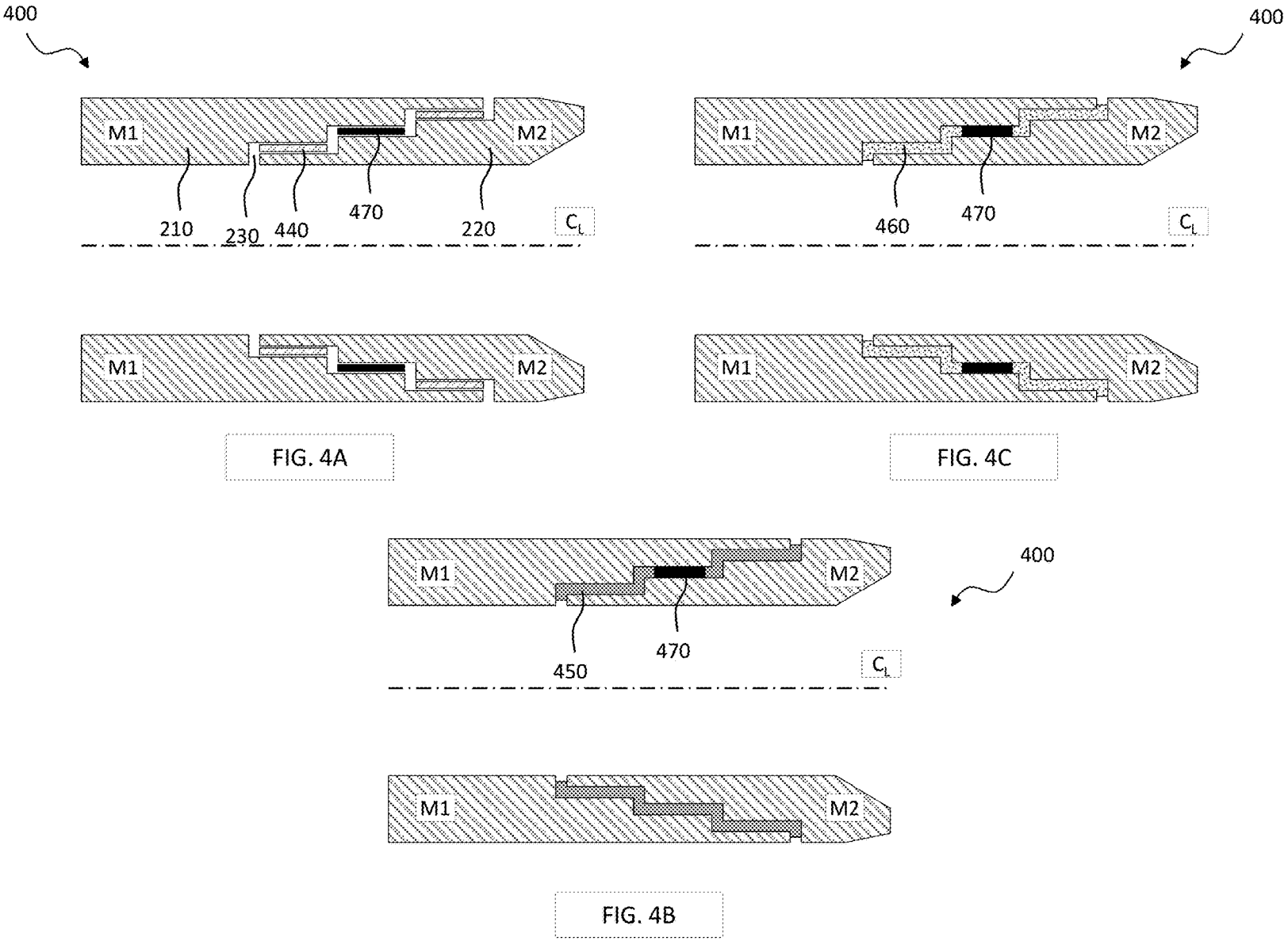

Turning now to FIGS. 4A through 4C, depicted are various different manufacturing states for a junction 400 designed, manufactured and operated according to an alternative embodiment of the disclosure. FIG. 4A illustrates the junction 400 pre-expansion, FIG. 4B illustrates the junction 400 post-expansion, and FIG. 4C illustrates the junction 400 post-expansion and containing residual unreacted expandable metal therein. The junction 400 of FIGS. 4A through 4C is similar in many respects to the junction 300 of FIGS. 3A through 3C. Accordingly, like reference numbers have been used to illustrate similar, if not identical, features. The junction 400 differs, for the most part, from the junction 300, in that the junction 400 includes an elastomeric sealing member 470 positioned in the overlapping space 230. For example, in the illustrated embodiment, the elastomeric sealing member 470 is positioned between ones of the multiple pre-expansion metal joints 440, multiple expanded metal joints 450, or multiple expanded metal joints 460 containing residual unreacted expandable metal therein, depending on the illustrated view. When the pre-expansion metal joint 440 expands into the expanded metal joint 450, the elastomeric sealing member 470 may be compressed. Accordingly, the junction 400 is both an anchoring and sealing junction.

Figures 5A, 5B, 5C:
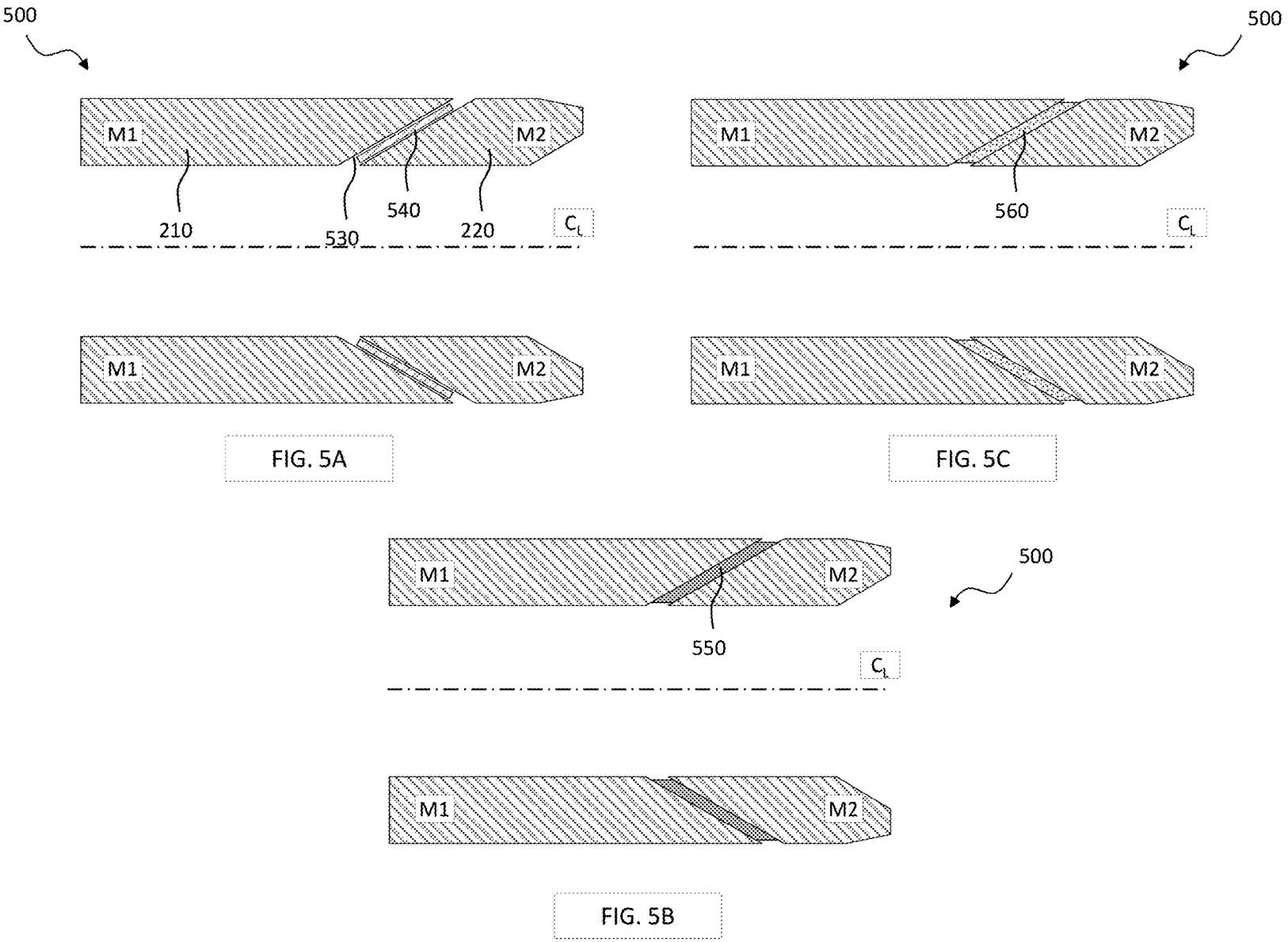

Turning now to FIGS. 5A through 5C, depicted are various different manufacturing states for a junction 500 designed, manufactured and operated according to an alternative embodiment of the disclosure. FIG. 5A illustrates the junction 500 pre-expansion, FIG. 5B illustrates the junction 500 post-expansion, and FIG. 5C illustrates the junction 500 post-expansion and containing residual unreacted expandable metal therein. The junction 500 of FIGS. 5A through 5C is similar in many respects to the junction 200 of FIGS. 2A through 2C. Accordingly, like reference numbers have been used to illustrate similar, if not identical, features. The junction 500 differs, for the most part, from the junction 200, in that the junction 500 includes an angled overlapping space 530 having the pre-expansion metal joint 540, expanded metal joint 550, or expanded metal joint 560 containing residual unreacted expandable metal therein, depending on the illustrated view.

Figures 6A, 6B, 6C:
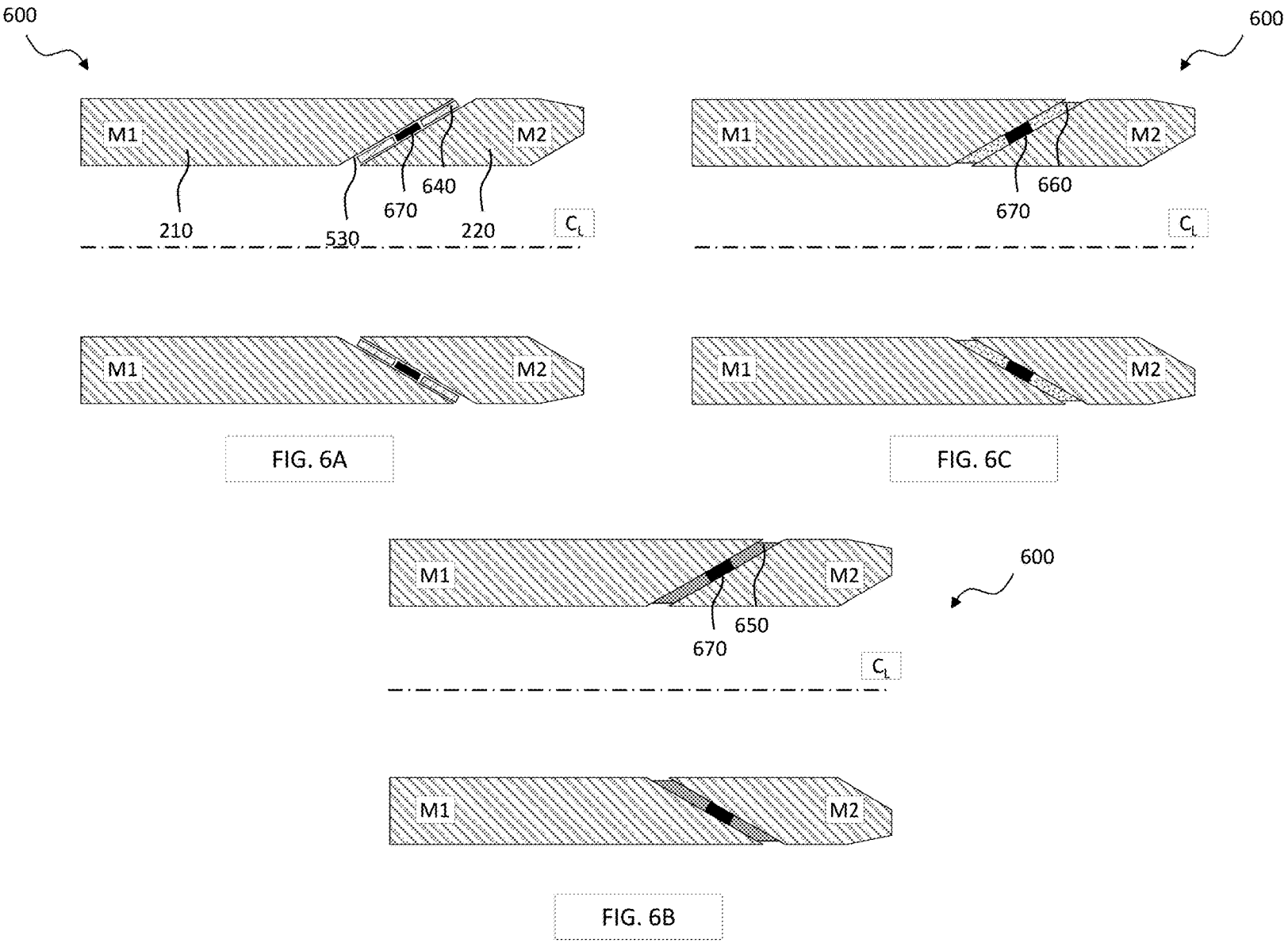

Turning now to FIGS. 6A through 6C, depicted are various different manufacturing states for a junction 600 designed, manufactured and operated according to an alternative embodiment of the disclosure. FIG. 6A illustrates the junction 600 pre-expansion, FIG. 6B illustrates the junction 600 post-expansion, and FIG. 6C illustrates the junction 600 post-expansion and containing residual unreacted expandable metal therein. The junction 600 of FIGS. 6A through 6C is similar in many respects to the junction 500 of FIGS. 5A through 5C. Accordingly, like reference numbers have been used to illustrate similar, if not identical, features. The junction 600 differs, for the most part, from the junction 500, in that the junction 600 includes an elastomeric sealing member 670 positioned in the overlapping space 530. For example, in the illustrated embodiment, the elastomeric sealing member 670 is positioned between ones of the multiple pre-expansion metal joints 640, multiple expanded metal joints 650, or multiple expanded metal joints 660 containing residual unreacted expandable metal therein, depending on the illustrated view. When the pre-expansion metal joint 640 expands into the expanded metal joint 650, the elastomeric sealing member 670 may be compressed. Accordingly, the junction 600 is both an anchoring and sealing junction.

Figures 7A, 7B, 7C:
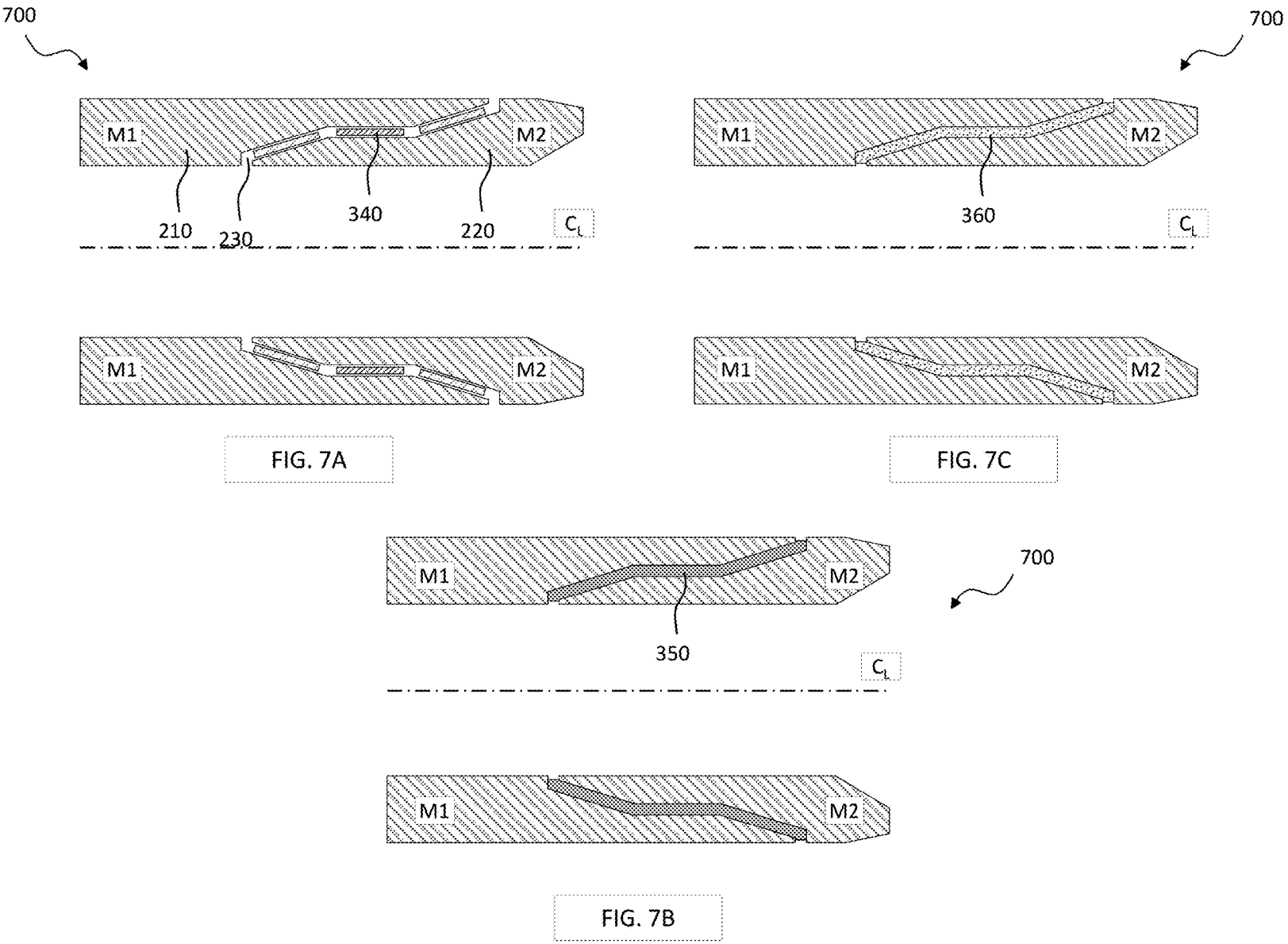

Turning now to FIGS. 7A through 7C, depicted are various different manufacturing states for a junction 700 designed, manufactured and operated according to an alternative embodiment of the disclosure. FIG. 7A illustrates the junction 700 pre-expansion, FIG. 7B illustrates the junction 700 post-expansion, and FIG. 7C illustrates the junction 700 post-expansion and containing residual unreacted expandable metal therein. The junction 700 of FIGS. 7A through 7C is similar in many respects to the junction 300 of FIGS. 3A through 3C. Accordingly, like reference numbers have been used to illustrate similar, if not identical, features. The junction 700 differs, for the most part, from the junction 300, in that the junction 700 includes parallel and angled portions.

Figures 8A, 8B, 8C:
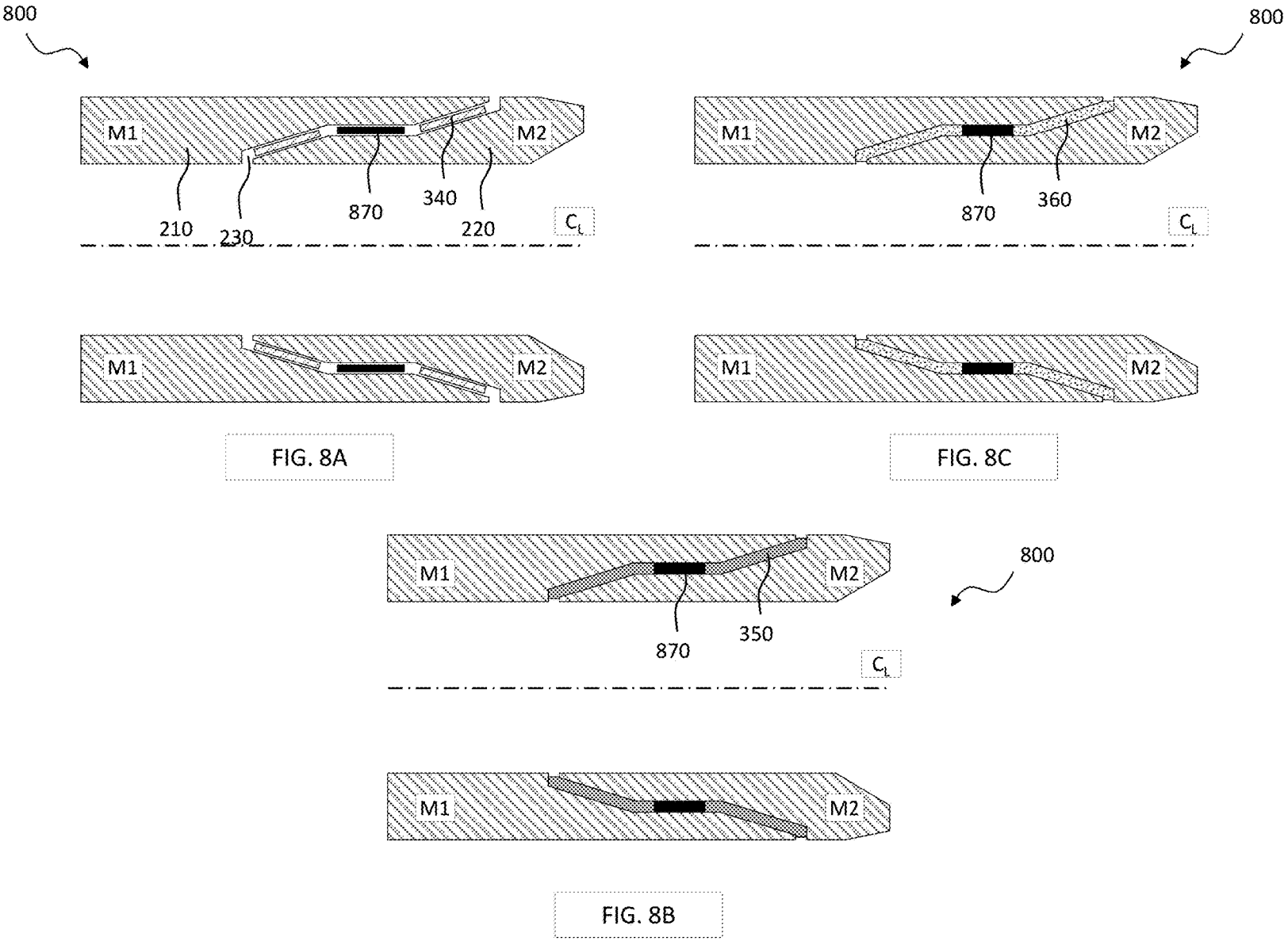

Turning now to FIGS. 8A through 8C, depicted are various different manufacturing states for a junction 800 designed, manufactured and operated according to an alternative embodiment of the disclosure. FIG. 8A illustrates the junction 800 pre-expansion, FIG. 8B illustrates the junction 800 post-expansion, and FIG. 8C illustrates the junction 800 post-expansion and containing residual unreacted expandable metal therein. The junction 800 of FIGS. 8A through 8C is similar in many respects to the junction 700 of FIGS. 7A through 7C. Accordingly, like reference numbers have been used to illustrate similar, if not identical, features. The junction 800 differs, for the most part, from the junction 700, in that the junction 800 includes an elastomeric sealing member 870 positioned in the overlapping space 230. For example, in the illustrated embodiment, the elastomeric sealing member 870 is positioned between ones of the multiple pre-expansion metal joints 340, multiple expanded metal joints 350, or multiple expanded metal joints 360 containing residual unreacted expandable metal therein, depending on the illustrated view. When the pre-expansion metal joint 340 expands into the expanded metal joint 350, the elastomeric sealing member 870 may be compressed. Accordingly, the junction 800 is both an anchoring and sealing junction.

Figures 9A, 9B, 9C:
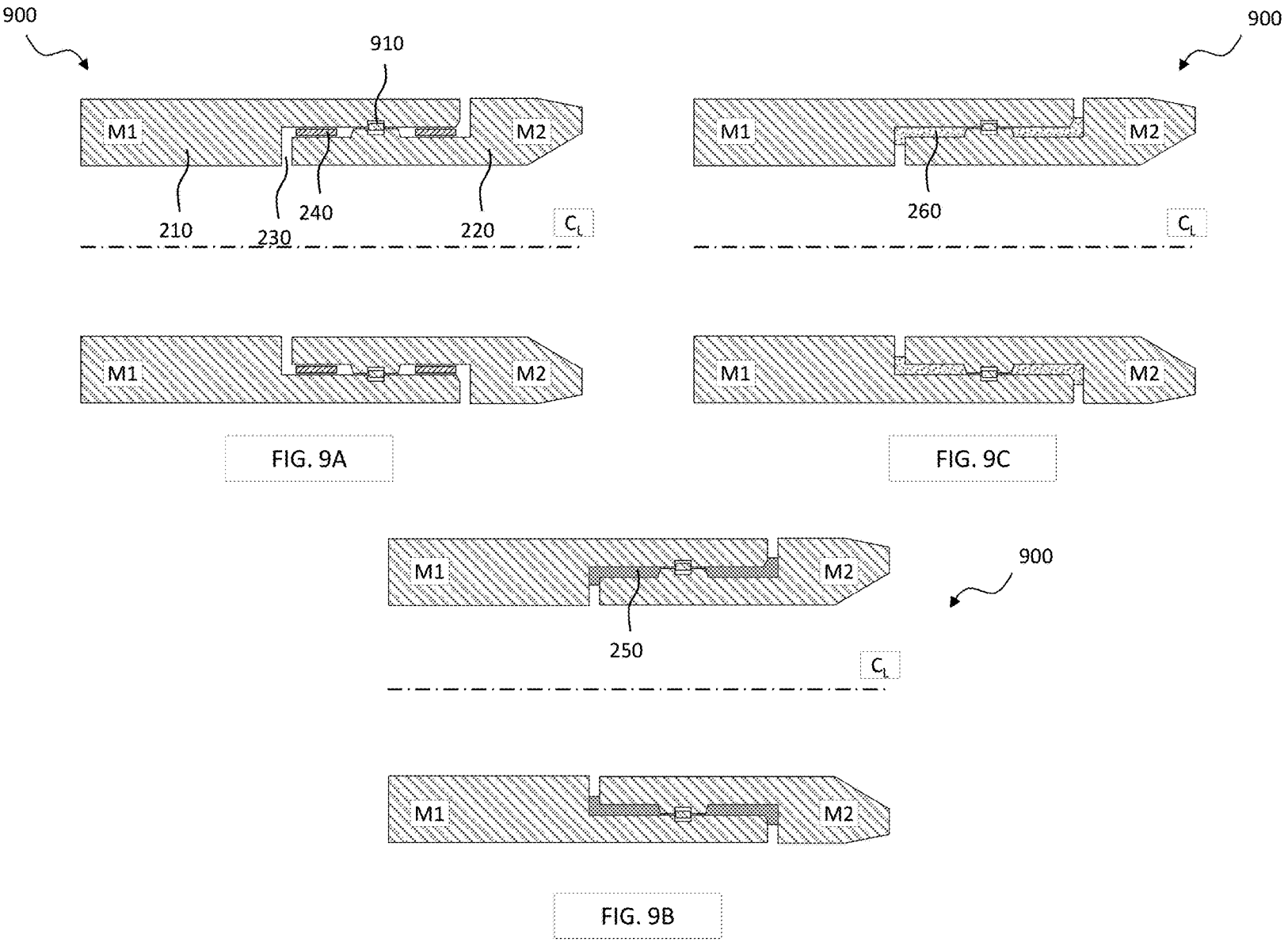

Turning now to FIGS. 9A through 9C, depicted are various different manufacturing states for a junction 900 designed, manufactured and operated according to an alternative embodiment of the disclosure. FIG. 9A illustrates the junction 900 pre-expansion, FIG. 9B illustrates the junction 900 post-expansion, and FIG. 9C illustrates the junction 900 post-expansion and containing residual unreacted expandable metal therein. The junction 900 of FIGS. 9A through 9C is similar in certain respects to the junction 200 of FIGS. 2A through 2C. Accordingly, like reference numbers have been used to illustrate similar, if not identical, features. The junction 900 differs, for the most part, from the junction 200, in that the junction 900 In accordance with one embodiment, such as that shown, the locking feature 910 is a snap ring, for example used to support the axial loads. In this embodiment, the pre-expansion metal joint 240, expanded metal joint 250, and expanded metal joint 260 containing residual unreacted expandable metal therein, may only be necessary to seal the junction 900. In another embodiment, the locking feature 910 could be an internal slip, or any other known locking feature.

Figure 9D:
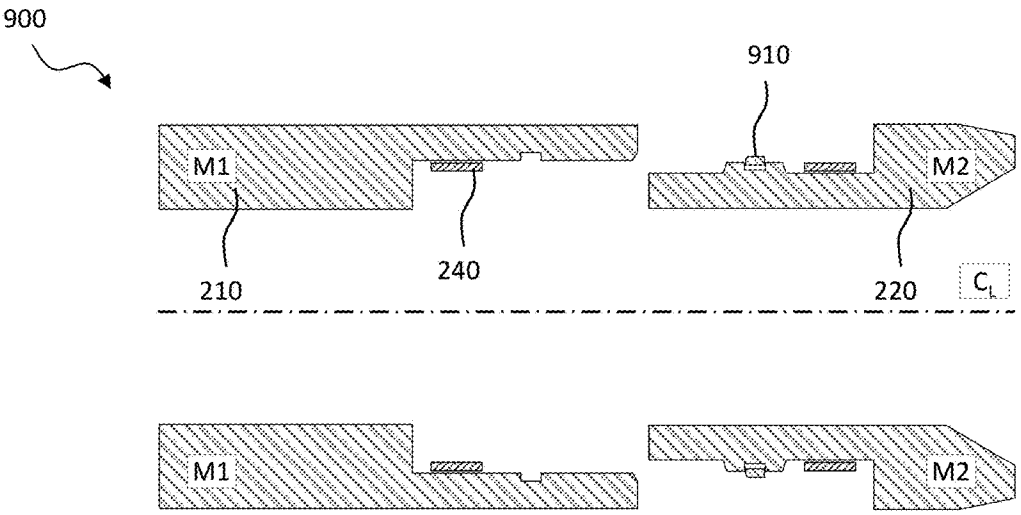

Turning now to FIGS. 9D through 9G, illustrated is one embodiment for forming the junction 900. FIG. 9D illustrates the first member 210 and the second member 220 entirely apart from one another. As shown, the locking feature 910 is in the radially expanded (e.g., locked) state. As further shown, the locking feature 910 includes an angled or chamfered face, such that it is urged to move to the radially retracted state when the locking feature 910 engages with the first member 210. Additionally, the first member 210 includes a locking feature profile 920 in the embodiment shown.

Figure 9E:
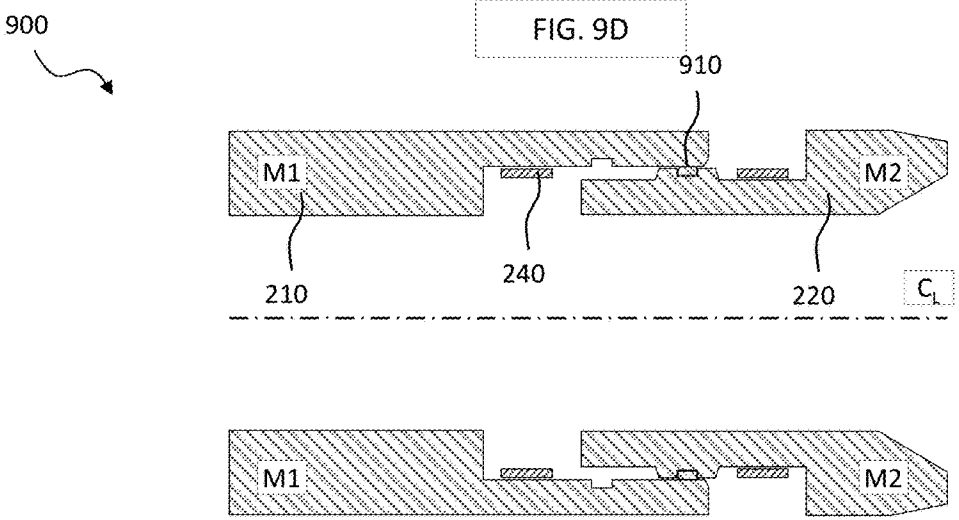

FIG. 9E illustrates the first member 210 and the second member 220 wherein they are partially overlapping one another. As shown, the locking feature 910 is in the radially retracted state. For instance, a chamfered edge of the first member 210 could engage with an angled or chamfered edge of the locking feature 910 to urge the locking feature 910 to the radially retracted state. Accordingly, the first member 210 and the second member 220 are still allowed to slide relative to one another.

Figure 9F:
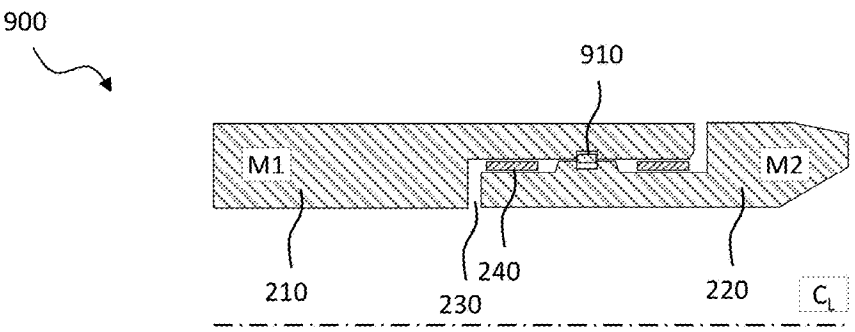
Figure 9F:
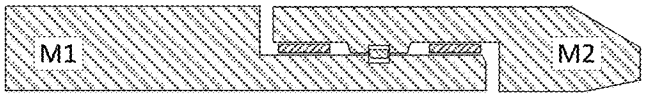

FIG. 9F illustrated the first member 210 and the second member 220 in their final axial state. At this stage, the locking feature 910 is axially aligned with a locking feature profile 920 in the first member 210, and thus the locking feature 910 is allowed to radially expand into the locking feature profile 920 and axially fix the first member 210 relative to the second member 220. Thus, the first member 210 and the second member 220 are no longer allowed to slide relative to one another, and thus form the overlapping space 230.

Figure 9G:
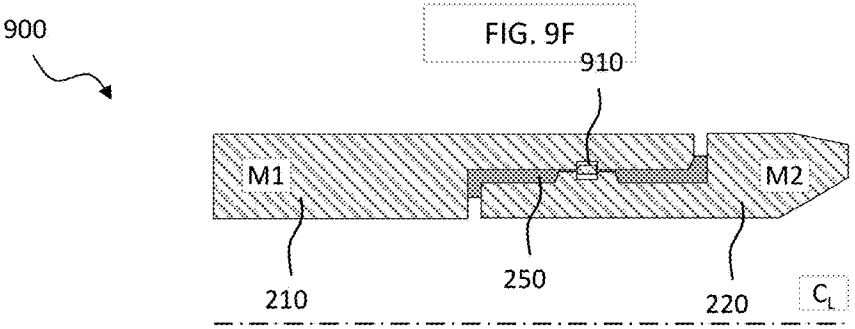
Figure 9G:
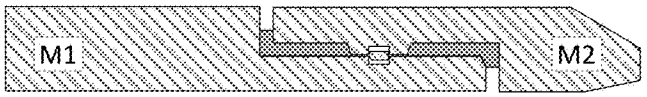

FIG. 9G illustrates the junction 900 of FIG. 9F, after the pre-expansion joint 240 has been subjected to an activation fluid to expand the metal in the overlapping space 230, and thereby form an expanded metal joint 250. In the illustrated embodiment, the expanded metal joint 250 generally fills the overlapping space 230, as that term is defined above. In yet other embodiments, the expanded metal joint 250 substantially fills the overlapping space 230, as that term is defined above, or in yet other embodiments, the expanded metal joint 250 excessively fills the overlapping space 230, as that term is defined above.

Figures 10A, 10B, 10C:
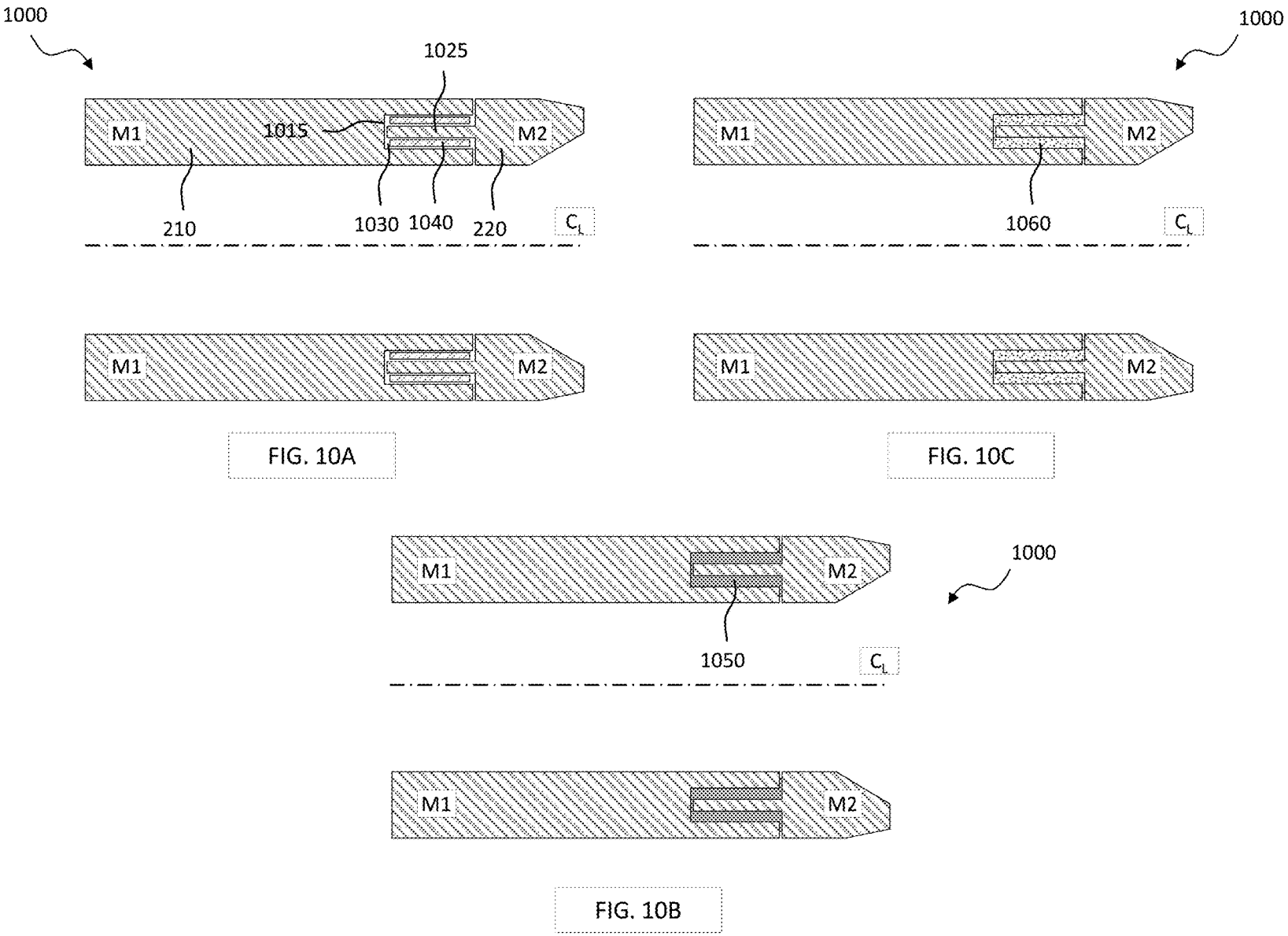

Turning now to FIGS. 10A through 10C, depicted are various different manufacturing states for a junction 1000 designed, manufactured and operated according to an alternative embodiment of the disclosure. FIG. 10A illustrates the junction 1000 pre-expansion, FIG. 10B illustrates the junction 1000 post-expansion, and FIG. 10C illustrates the junction 1000 post-expansion and containing residual unreacted expandable metal therein. The junction 1000 of FIGS. 10A through 10C is similar in certain respects to the junction 200 of FIGS. 2A through 2C. Accordingly, like reference numbers have been used to illustrate similar, if not identical, features. The junction 1000 differs from the junction 200, in that the junction 1000 is a butt joint, and more specifically a tongue and groove butt joint. In the illustrated embodiment, the first member 210 includes a groove 1015, and the second member 220 includes a tongue 1025, the tongue 1025 fitting within the groove 1015 and forming the overlapping space 1030. Further to the embodiment of FIGS. 10A through 10C, multiple pre-expansion metal joints 1040, multiple expanded metal joints 1050, or multiple expanded metal joints 1060 containing residual unreacted expandable metal therein, depending on the illustrated view, are located in the overlapping space 1030, as described above.

Figures 11A, 11B, 11C:
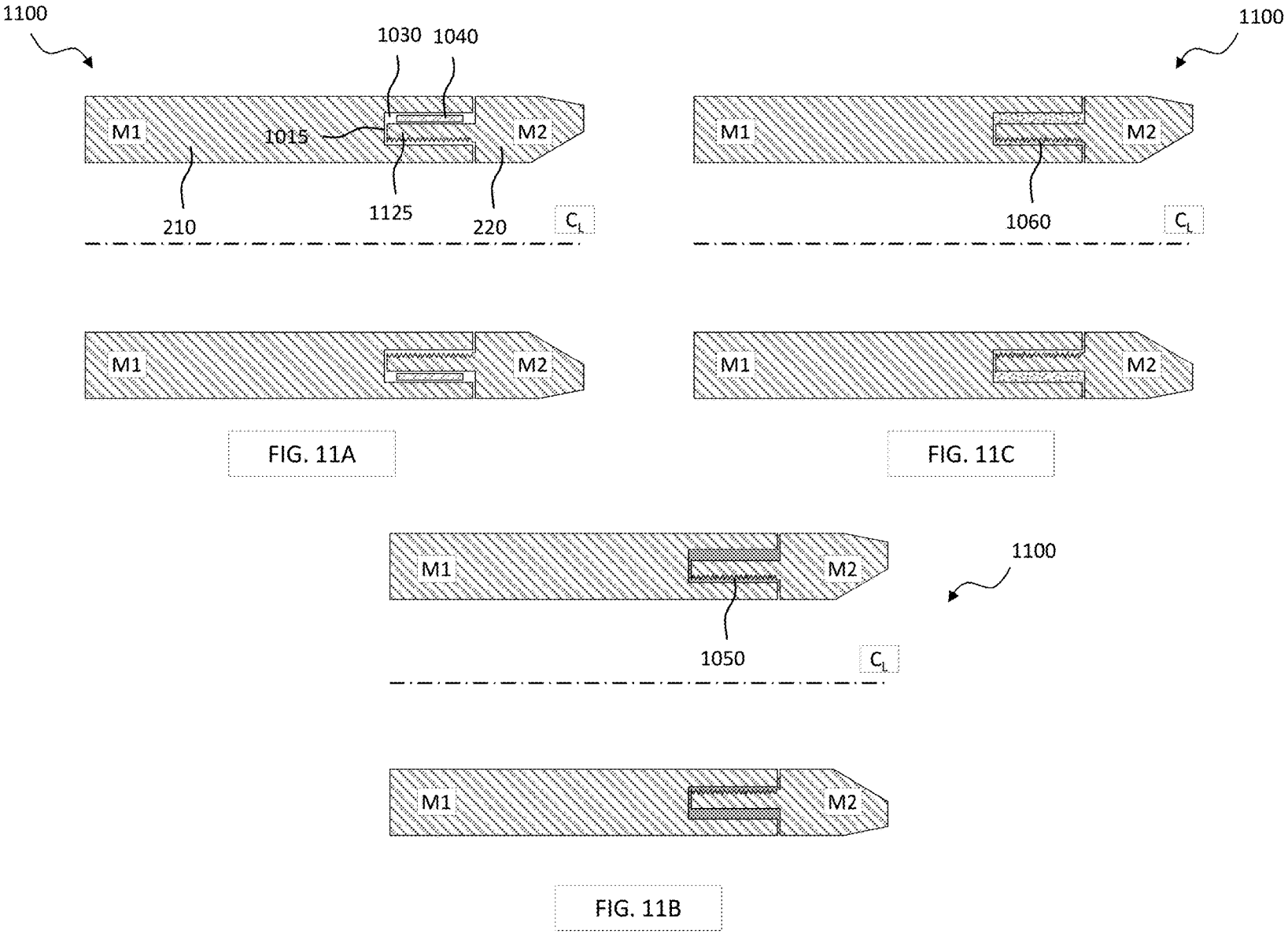

Turning now to FIGS. 11A through 11C, depicted are various different manufacturing states for a junction 1100 designed, manufactured and operated according to an alternative embodiment of the disclosure. FIG. 11A illustrates the junction 1100 pre-expansion, FIG. 11B illustrates the junction 1100 post-expansion, and FIG. 11C illustrates the junction 1100 post-expansion and containing residual unreacted expandable metal therein. The junction 1100 of FIGS. 11A through 11C is similar in many respects to the junction 1000 of FIGS. 10A through 10C. Accordingly, like reference numbers have been used to illustrate similar, if not identical, features. The junction 1100 differs from the junction 1000, in that it includes a roughened tongue 1125. The roughness of the roughened tongue 1125, in the illustrated embodiment, is located on an inside diameter of the roughened tongue 1125. Nevertheless, other embodiments exist wherein the roughness of the roughened tongue 1125 are located on an outside diameter of the roughened tongue 1125. The roughened tongue 1125, in the illustrated embodiment, provide a superior anchor.

In at least one embodiment, the roughened tongue 1125 includes one or more ridges and/or threads. Nevertheless, any type of roughened surface is within the scope of the disclosure. For example, the roughened tongue 1125 may have an average surface roughness ($R_a$) of at least about 0.8 μm. In yet another embodiment, the roughened tongue 1125 may have an average surface roughness ($R_a$) of at least about 6.3 μm, or in yet an even different embodiment may have an average surface roughness ($R_a$) of at least about 12.5 μm.

Figures 12A, 12B, 12C:
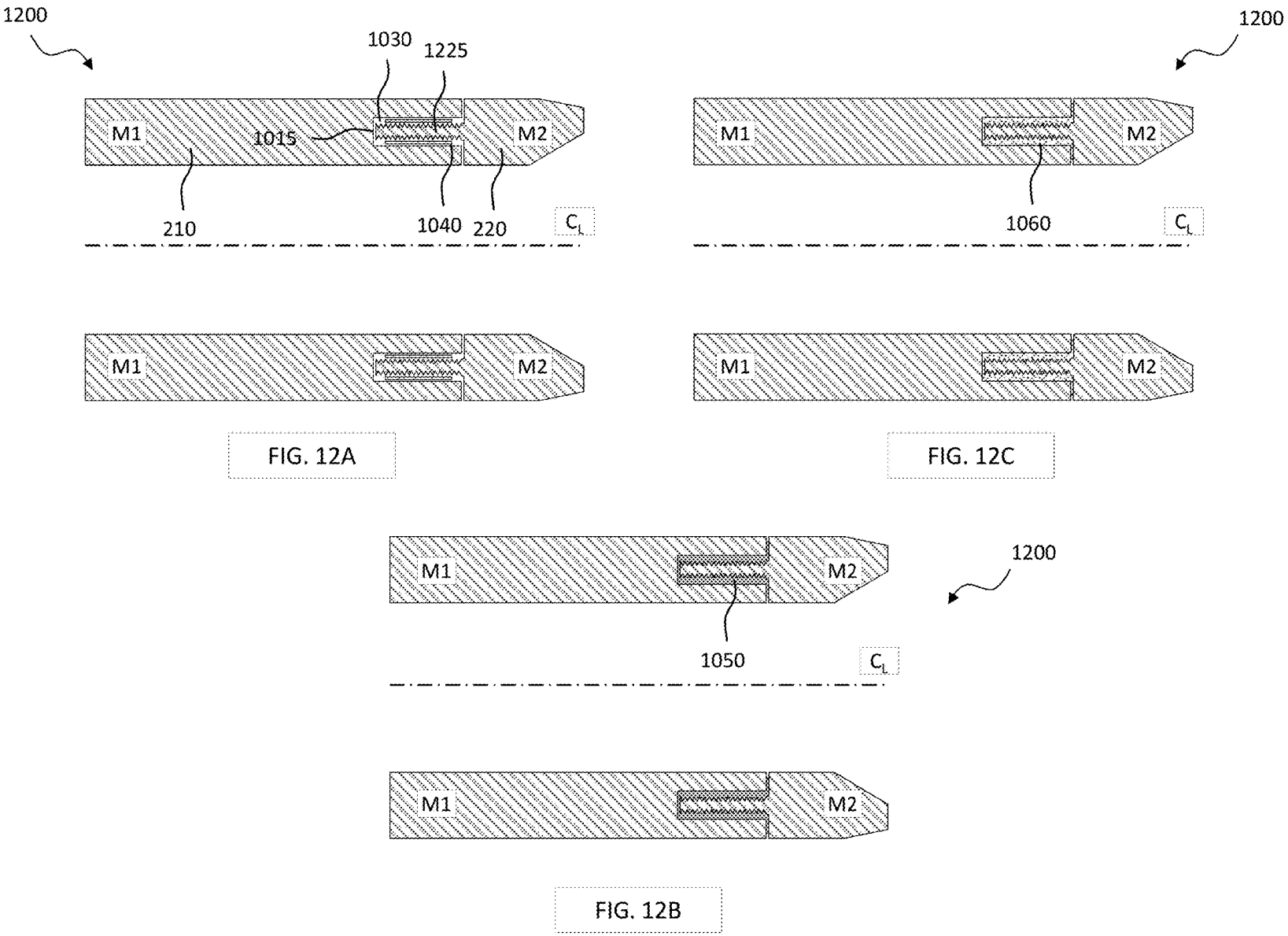

Turning now to FIGS. 12A through 12C, depicted are various different manufacturing states for a junction 1200 designed, manufactured and operated according to an alternative embodiment of the disclosure. FIG. 12A illustrates the junction 1200 pre-expansion, FIG. 12B illustrates the junction 1200 post-expansion, and FIG. 12C illustrates the junction 1200 post-expansion and containing residual unreacted expandable metal therein. The junction 1200 of FIGS. 12A through 12C is similar in many respects to the junction 1100 of FIGS. 11A through 11C. Accordingly, like reference numbers have been used to illustrate similar, if not identical, features. The junction 1200 differs from the junction 1100, in that the roughened tongue 1225 includes a roughened surface on both the inner diameter and the outer diameter thereof.

Figures 13A, 13B, 13C:
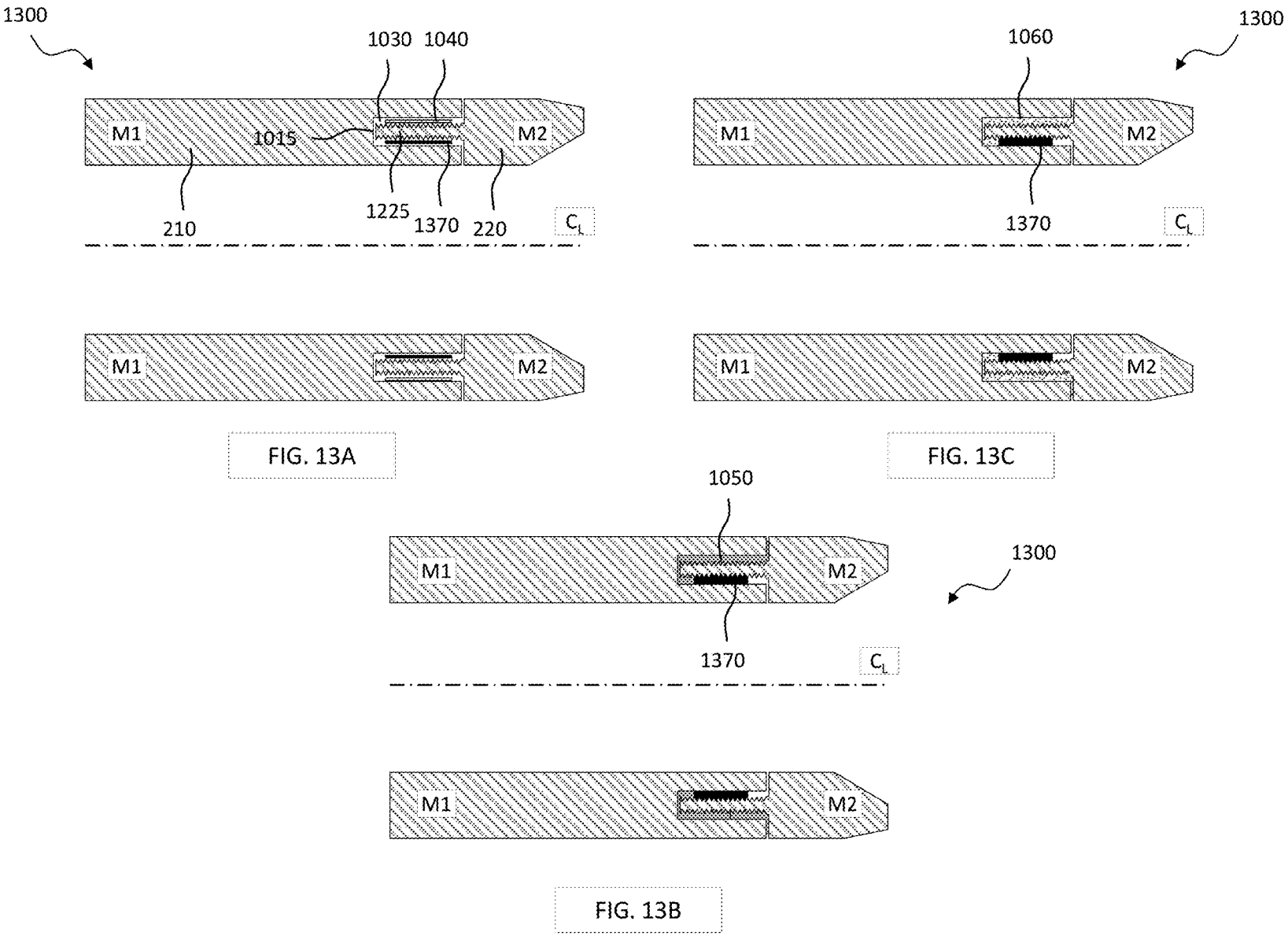

Turning now to FIGS. 13A through 13C, depicted are various different manufacturing states for a junction 1300 designed, manufactured and operated according to an alternative embodiment of the disclosure. FIG. 13A illustrates the junction 1300 pre-expansion, FIG. 13B illustrates the junction 1300 post-expansion, and FIG. 13C illustrates the junction 1300 post-expansion and containing residual unreacted expandable metal therein. The junction 1300 of FIGS. 13A through 13C is similar in many respects to the junction 1200 of FIGS. 12A through 12C. Accordingly, like reference numbers have been used to illustrate similar, if not identical, features. The junction 1300 differs from the junction 1200, in that it includes an elastomeric sealing member 1370 positioned along the inner diameter of the roughened tongue 1225. In an alternative embodiment, the elastomeric sealing member 1370 could be placed on the outside diameter of the roughened tongue 1225, whereas the pre-expansion joint 1040 could be placed on the inside diameter of the roughened tongue 1225.

Figures 14A, 14B, 14C:
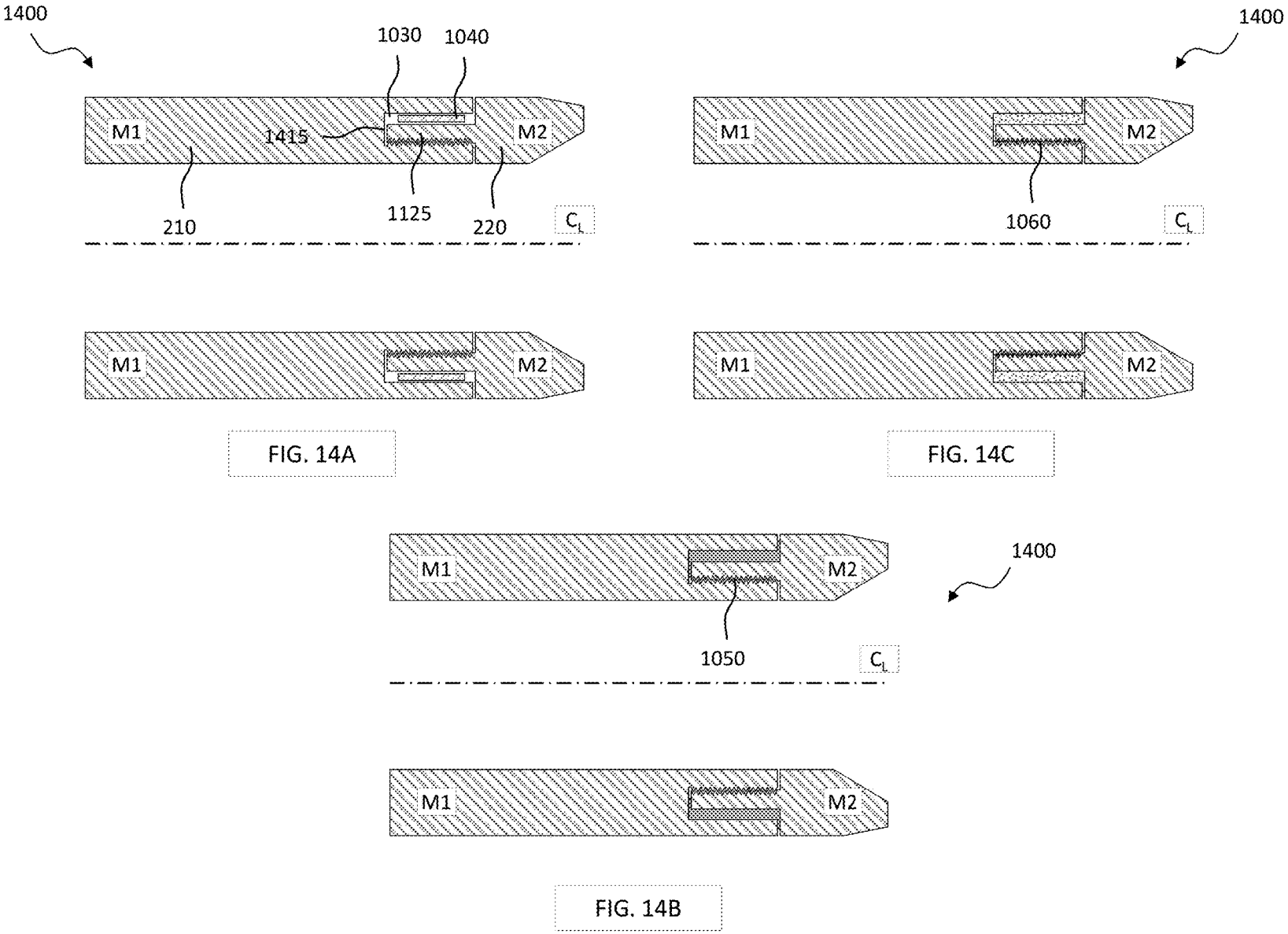

Turning now to FIGS. 14A through 14C, depicted are various different manufacturing states for a junction 1400 designed, manufactured and operated according to an alternative embodiment of the disclosure. FIG. 14A illustrates the junction 1400 pre-expansion, FIG. 14B illustrates the junction 1400 post-expansion, and FIG. 14C illustrates the junction 1400 post-expansion and containing residual unreacted expandable metal therein. The junction 1400 of FIGS. 14A through 14C is similar in many respects to the junction 1100 of FIGS. 11A through 11C. Accordingly, like reference numbers have been used to illustrate similar, if not identical, features. The junction 1400 differs from the junction 1100, in that it includes a roughened groove 1415. In the illustrated embodiment, the roughened tongue 1125 and the roughened groove 1415 are a threaded tongue and a threaded groove. In accordance with this embodiment, threads on the threaded groove substantially align with grooves on the threaded tongue, thereby providing superior anchoring.

Figures 15A, 15B, 15C:
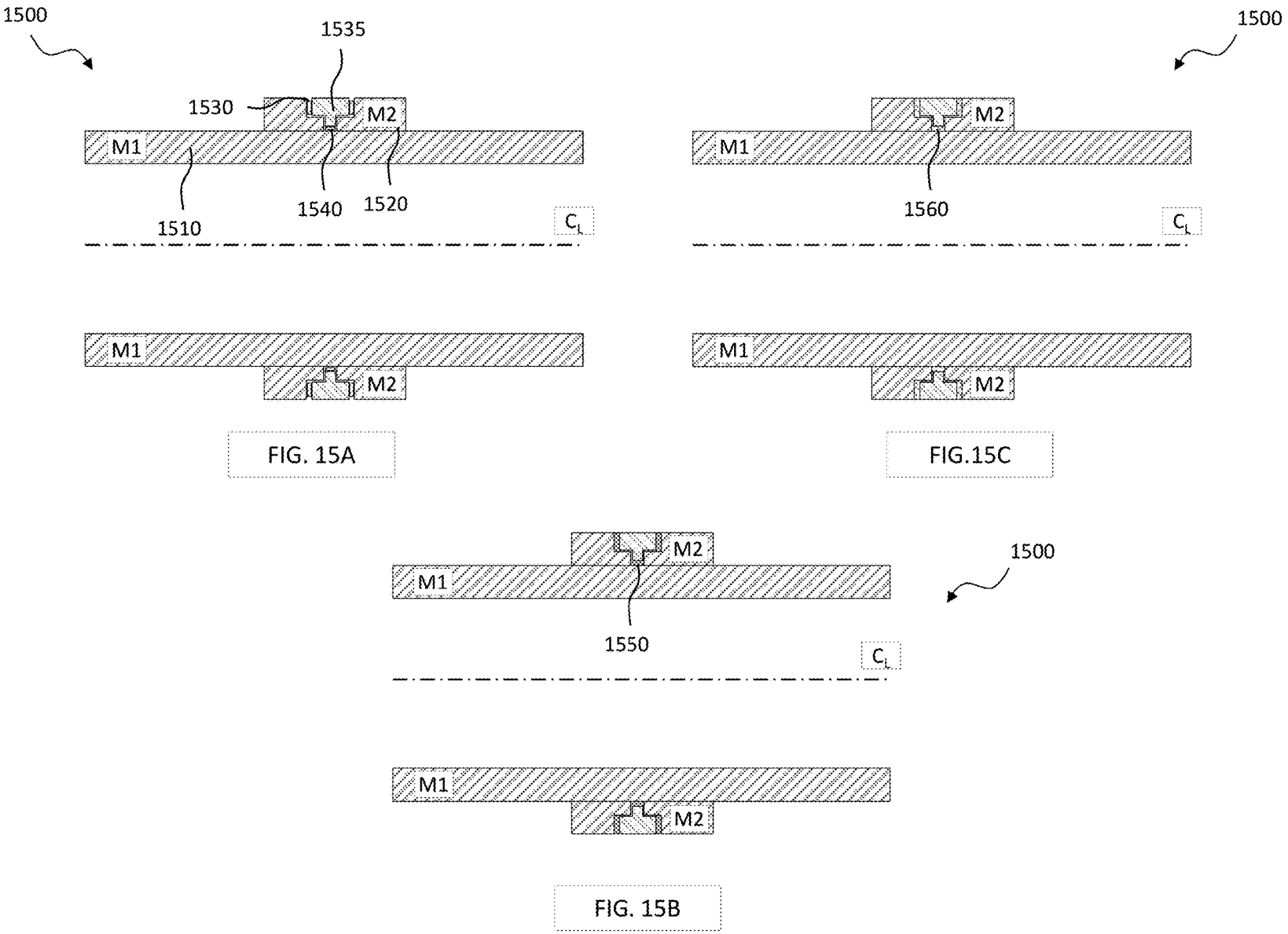

Turning now to FIGS. 15A through 15C, depicted are various different manufacturing states for a junction 1500 designed, manufactured and operated according to an alternative embodiment of the disclosure. FIG. 15A illustrates the junction 1500 pre-expansion, FIG. 15B illustrates the junction 1500 post-expansion, and FIG. 15C illustrates the junction 1500 post-expansion and containing residual unreacted expandable metal therein. The junction 1500 of FIGS. 15A through 15C, in contrast to those disclosed above, is an expanded metal plug joint, for example, as might be used to join the face of two different materials. The junction 1500, in the illustrated embodiment, includes a first member 1510 and a second member 1520. The first member 1510 and the second member 1520 overlap one another to form an overlapping space 1530. Further to the embodiment of FIG. 15, a plug 1535 is positioned within the overlapping space 1530. Additionally, a pre-expansion metal joint 1540, an expanded metal joint 1550, and/or an expanded metal joint 1560 containing residual unreacted expandable metal therein, depending on the illustrated view, are located in the overlapping space 1530, as described above.

Figures 16A, 16B, 16C:
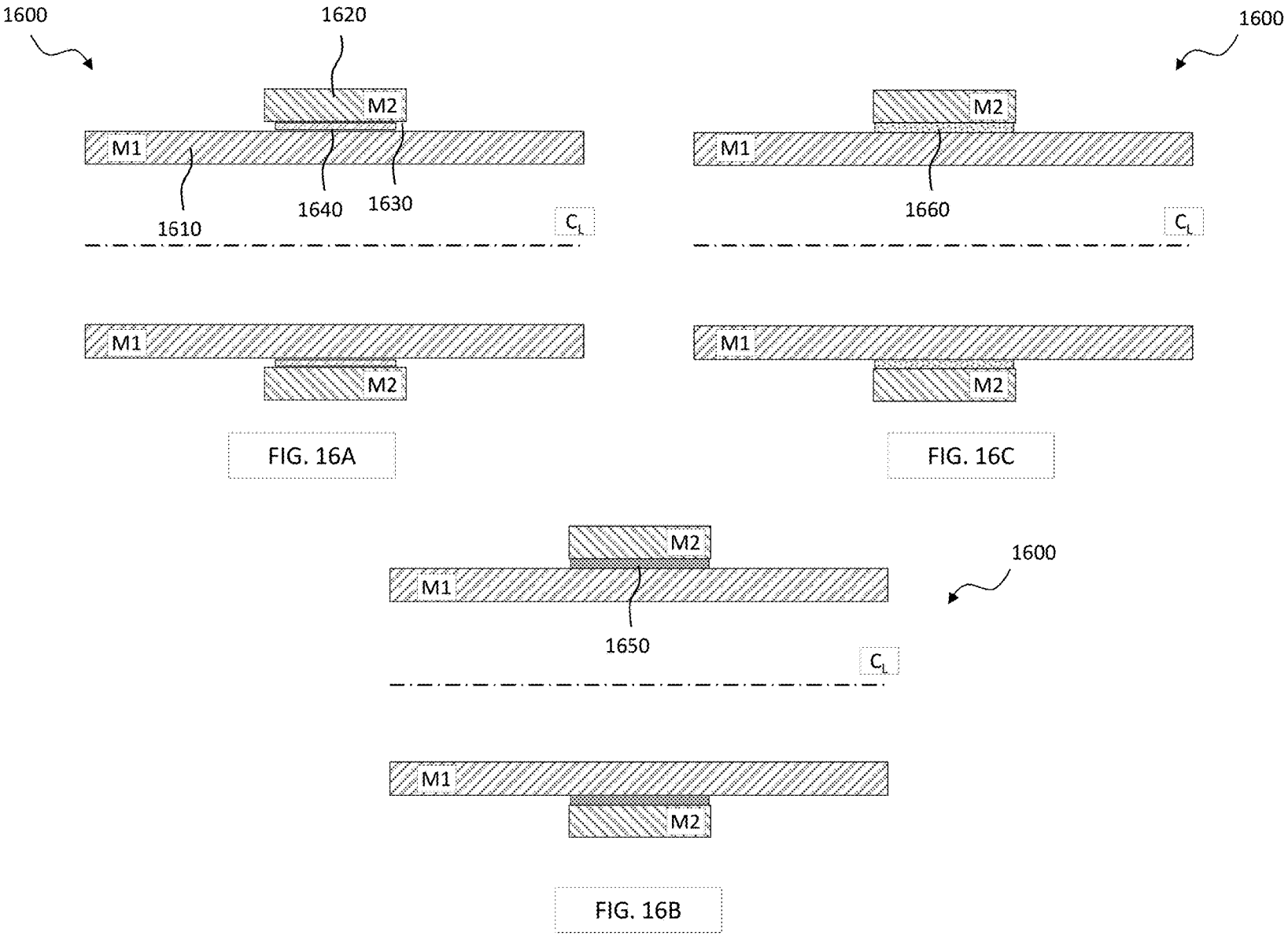

Turning now to FIGS. 16A through 16C, depicted are various different manufacturing states for a junction 1600 designed, manufactured and operated according to an alternative embodiment of the disclosure. FIG. 16A illustrates the junction 1600 pre-expansion, FIG. 16B illustrates the junction 1600 post-expansion, and FIG. 16C illustrates the junction 1600 post-expansion and containing residual unreacted expandable metal therein. The junction 1600 of FIGS. 16A through 16C, in contrast to those disclosed above, is a face joint. The junction 1600, in the illustrated embodiment, includes a first member 1610 and a second member 1620. The first member 1610 and the second member 1620 overlap one another to form an overlapping space 1630. Further to the embodiment of FIG. 16, a pre-expansion metal joint 1640, an expanded metal joint 1650, and/or an expanded metal joint 1660 containing residual unreacted expandable metal therein, depending on the illustrated view, are located in the overlapping space 1630, as described above.

Shrink fits are commonly used in interval control valves for various different purposes. For example, shrink fits are commonly used to connect an abrasion resistant tip to the sliding sleeve of the interval control valve. In another example, an abrasion resistant sleeve, such as a carbide (e.g., tungsten carbide) abrasion resistant sleeve, may be connected to metallic cages using the shrink fits, for example for erosion protection in deflectors and shroud adapters.

Figure 17:
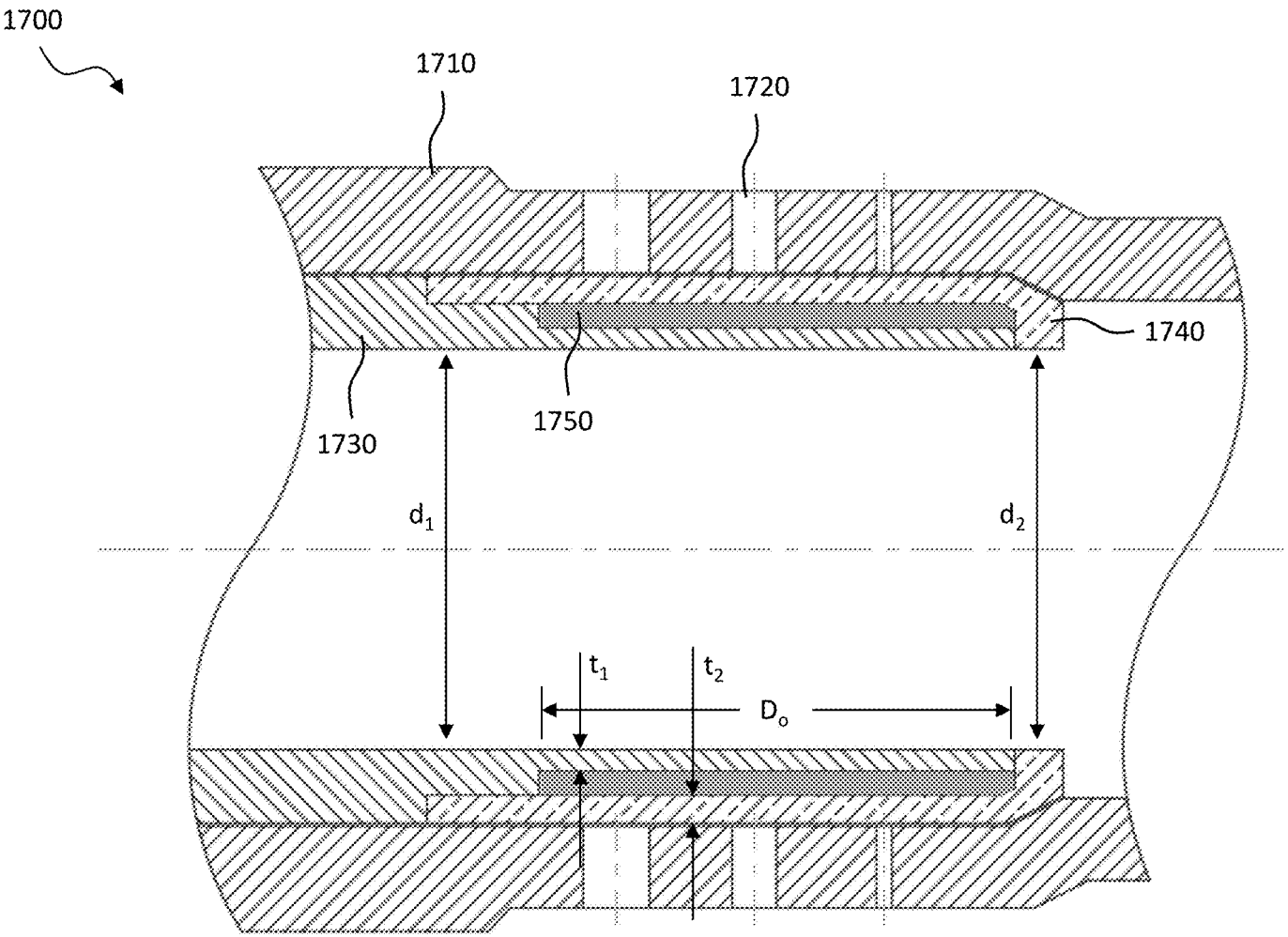
FIGS. 17 through 22 illustrate various different embodiments for interval control valves designed, manufactured and operated according to one or more embodiments of the disclosure.

Turning to FIG. 17, illustrated is an interval control valve 1700 designed, manufactured and operated according to one or more embodiments of the disclosure. The interval control valve 1700, in the illustrated embodiment, includes a tubular housing 1710. The tubular housing 1710, in at least one embodiment, has one or more openings 1720 extending there through. As those skilled in the art appreciate, the one or more openings 1720 in the tubular housing 1710 provide a fluid path between an exterior of the interval control valve 1700 and an interior of the interval control valve 1700.

The interval control valve 1700 illustrated in FIG. 17 additionally includes a sliding sleeve 1730 positioned within the tubular 1710. In the illustrated embodiment, the sliding sleeve 1730 is configured to move between a closed position (e.g., as shown) closing a fluid path between the one or more opening 1720 and an interior of the tubular housing 1710, and an open position (e.g., not shown) opening the fluid path between the one or more openings 1720 and the interior of the tubular housing 1710.

The interval control valve 1700, in at least one embodiment, further includes a tubular 1740 overlapping with the sliding sleeve 1730. As discussed in great detail above, the overlap of the tubular 1740 and the sliding sleeve 1730 defines an overlapping space (e.g., not shown). In at least one embodiment, the sliding sleeve 1730 and the tubular 1740 comprise different materials. For example, the sliding sleeve 1730 could be steel, whereas the tubular 1740 could be a carbide material, such as tungsten carbide. In this embodiment, the tubular 1740 could be an abrasion resistant tip, such as a carbide (e.g., tungsten carbide) abrasion resistant tip.

In the illustrated embodiment, the sliding sleeve 1730 has a first wall thickness ($t_1$) proximate the overlapping space and the tubular 1740 has a second wall thickness ($t_2$) proximate the overlapping space. In accordance with at least one embodiment, the first wall thickness ($t_1$) and the second wall thickness ($t_2$) are no more than 5.0 cm. Nevertheless, in at least one other embodiment, the first wall thickness ($t_1$) and the second wall thickness ($t_2$) are no more than 1.25 cm. Nevertheless, in at least yet another embodiment, the first wall thickness ($t_1$) and the second wall thickness ($t_2$) are between about 0.15 cm and about 0.635 cm. Nevertheless, in at least yet another embodiment, the first wall thickness ($t_1$) and the second wall thickness ($t_2$) are no more than 0.7 cm. Thus, in accordance with the embodiment shown, the sliding sleeve 1730 and the tubular 1740 are thin walled structures.

In the illustrated embodiment, the sliding sleeve 1730 has a first inside diameter ($d_1$) proximate the overlapping space and the tubular 1740 has a second inside diameter ($d_2$) proximate the overlapping space. In the illustrated embodiment, the overlapping space (and thus the resulting expanded metal joint) is positioned proximate an end of the sliding sleeve 1730 or tubular 1740. In accordance with at least one embodiment, the overlapping space (and thus the resulting expanded metal joint) is positioned less than a distance ($D_p$) from the end of the sliding sleeve 1730 or tubular 1740. The distance ($D_p$), in one or more embodiments, is equal to or less than four times the first inside diameter ($d_1$). The distance ($D_p$), in one or more other embodiments, is equal to or less than two times the first inside diameter ($d_1$).

In the illustrated embodiment, the sliding sleeve 1730 and the tubular 1740 overlap by a distance ($D_o$). In at least one embodiment, the overlap distance ($D_o$) between the sliding sleeve 1730 and the tubular 1740 is less than 120 cm. In yet another embodiment, the overlap distance ($D_o$) between the sliding sleeve 1730 and the tubular 1740 is less than 40 cm. In yet another embodiment, the overlap distance ($D_o$) between the sliding sleeve 1730 and the tubular 1740 is less than 10 cm. Essentially, as the sliding sleeve 1730 and the tubular 1740 are thin walled structures in the embodiments of FIGS. 2A through 2C, the overlap distance ($D_o$) is not significant.

The interval control valve 1700, in at least one or more embodiment, additionally includes an expanded metal joint 1750 located in at least a portion of the overlapping space. In accordance with the disclosure, the expanded metal joint 1750 comprising a metal that has expanded in response to hydrolysis. For example, at some point of manufacture, the expanded metal joint 1750 was a pre-expansion metal joint comprising a metal configured to expand in response to hydrolysis, for example that was subjected to an activation fluid to expand the metal in the overlapping space and thereby form the expanded metal joint 1750. In many embodiments, the pre-expansion metal joint is subjected to the activation fluid uphole, or at or above ground level.

In the illustrated embodiment, the expanded metal joint 1750 generally fills the overlapping space, as that term is defined above. In yet other embodiments, the expanded metal joint 1750 substantially fills the overlapping space, as that term is defined above, or in yet other embodiments, the expanded metal joint 1750 excessively fills the overlapping space, as that term is defined above.

Notwithstanding the foregoing, the expanded metal joint 1750 may have a variety of different volumes and remain within the scope of the disclosure. Such volumes, as expected, are a function of the size of the overlapping space, the volume of the pre-expansion joint, and the composition of the pre-expansion joint, among other factors. Nevertheless, in at least one embodiment, the expanded metal joint 1750 has a volume of no more than 25,000 $cm^3$. In yet another embodiment, the overlapping space has a volume of no more than 7,750 $cm^3$. In at least one other embodiment, the expanded metal joint 1750 has a volume ranging from about 31.5 $mm^3$ to about 5,813 $cm^3$, and in yet another embodiment, the expanded metal joint 1750 has a volume ranging from about 4,282 $mm^3$ to about 96,700 $mm^3$.

The junction illustrated in FIG. 17 is a single step expanded metal joint. However, other embodiments may exist wherein a different shape of junction, and thus expanded metal joint, is used. For example, any one of the junctions, and thus expanded metal joints, illustrated and described with regard to FIGS. 2A through 16C could be used with the interval control valve 1700 and remain within the scope of the disclosure. In at least one embodiment, the interval control valve 1700 employs a junction similar to the junction of FIGS. 9A through 9G, and thus includes a locking feature.

Figure 18:
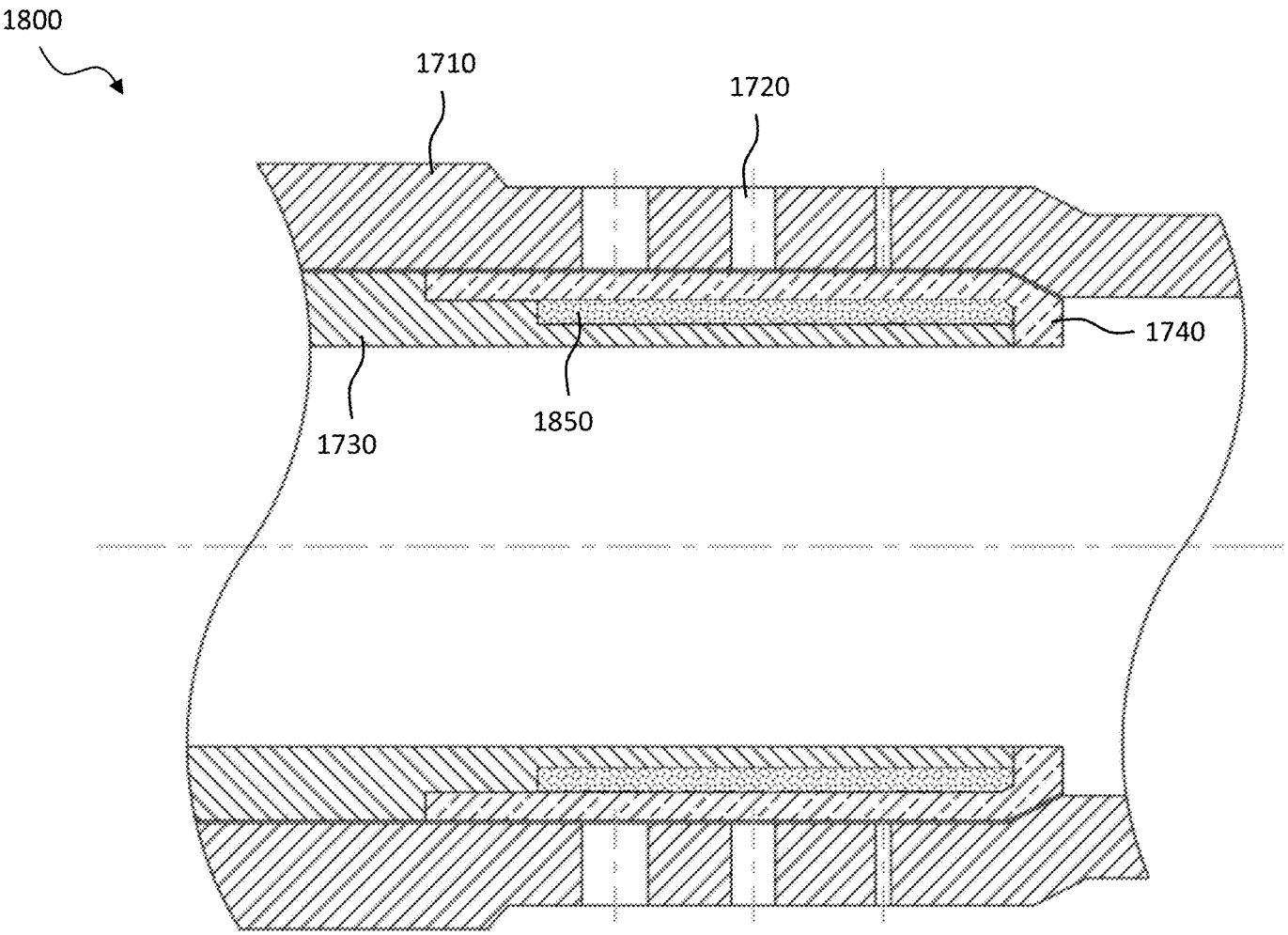

Turning now to FIG. 18, depicted is an interval control valve 1800 designed, manufactured and operated according to an alternative embodiment of the disclosure. The interval control valve 1800 of FIG. 18 is similar in many respects to the interval control valve 1700 of FIG. 17. Accordingly, like reference numbers have been used to illustrate similar, if not identical, features. The interval control valve 1800 of FIG. 18 differs from the interval control valve 1700 of FIG. 17, in that it includes an expanded metal joint 1850 having residual unreacted expandable metal therein, as further described above.

Figure 19:
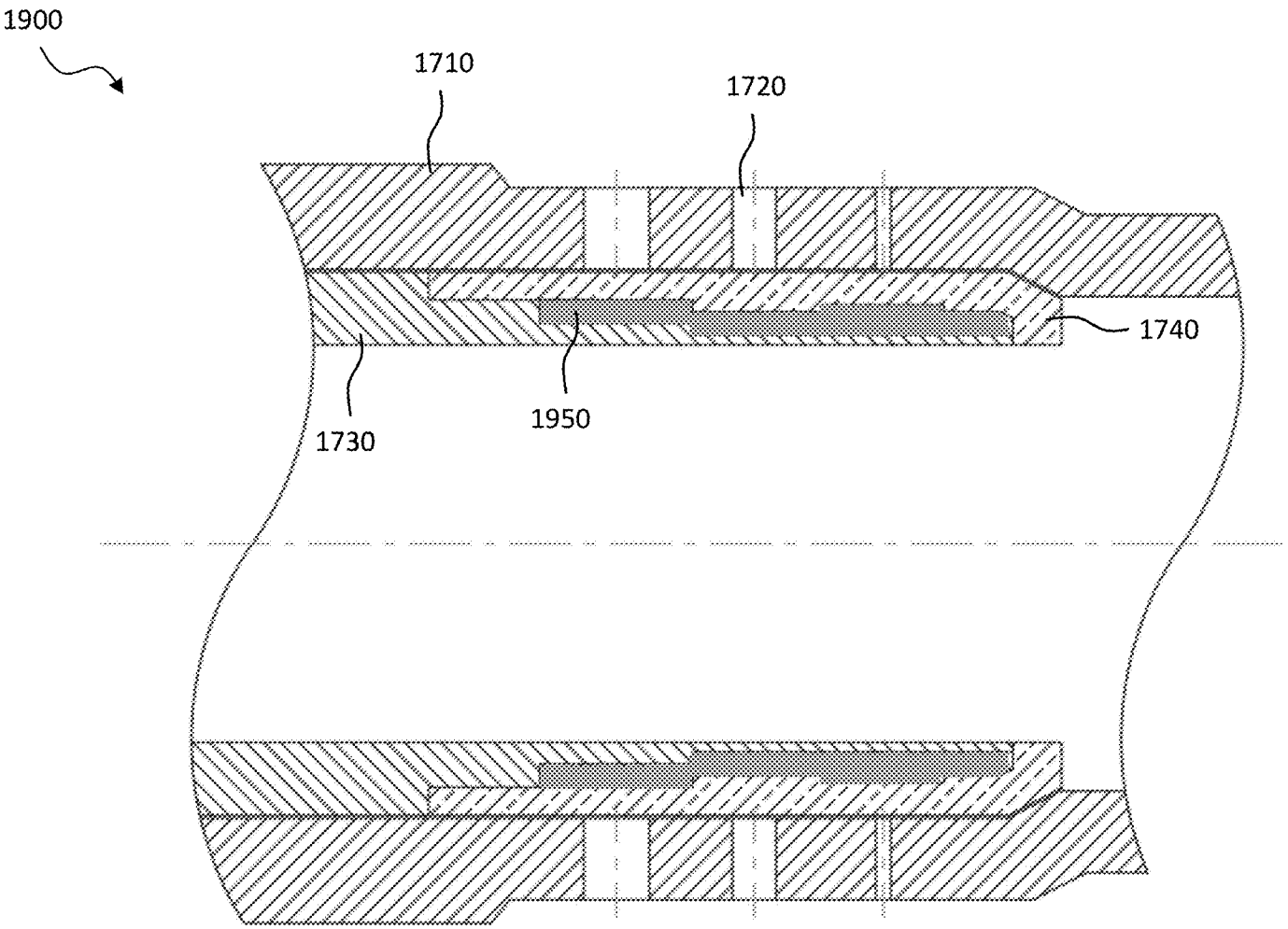

Turning now to FIG. 19, depicted is an interval control valve 1900 designed, manufactured and operated according to an alternative embodiment of the disclosure. The interval control valve 1900 of FIG. 19 is similar in many respects to the interval control valve 1700 of FIG. 17. Accordingly, like reference numbers have been used to illustrate similar, if not identical, features. The interval control valve 1900 of FIG. 19 differs from the interval control valve 1700 of FIG. 17, in that it includes a multi-step expanded metal joint 1950, as further described above. Accordingly, the multi-step expanded metal joint includes a first expanded metal joint and a second expanded metal joint, for example both comprising the metal that has expanded in response to hydrolysis.

Figure 20:
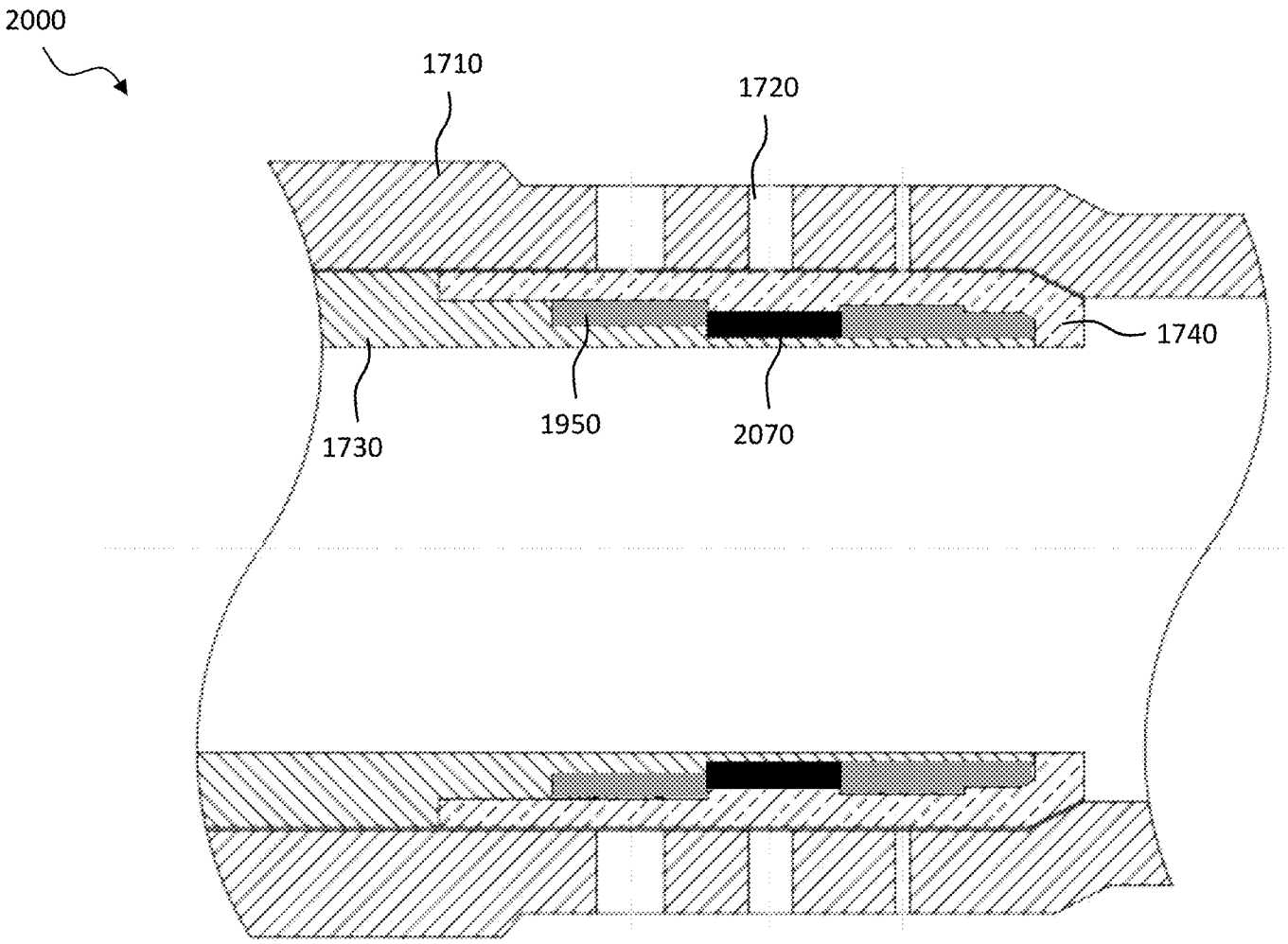

Turning now to FIG. 20, depicted is an interval control valve 2000 designed, manufactured and operated according to an alternative embodiment of the disclosure. The interval control valve 2000 of FIG. 20 is similar in many respects to the interval control valve 1900 of FIG. 19. Accordingly, like reference numbers have been used to illustrate similar, if not identical, features. The interval control valve 2000 of FIG. 20 differs from the interval control valve 1900 of FIG. 19, in that it includes an elastomeric sealing member 2070 positioned in the middle of a multi-step expanded metal joint 2050 (e.g., between the first expanded metal joint and the second expanded metal joint), as further described above.

Figure 21:
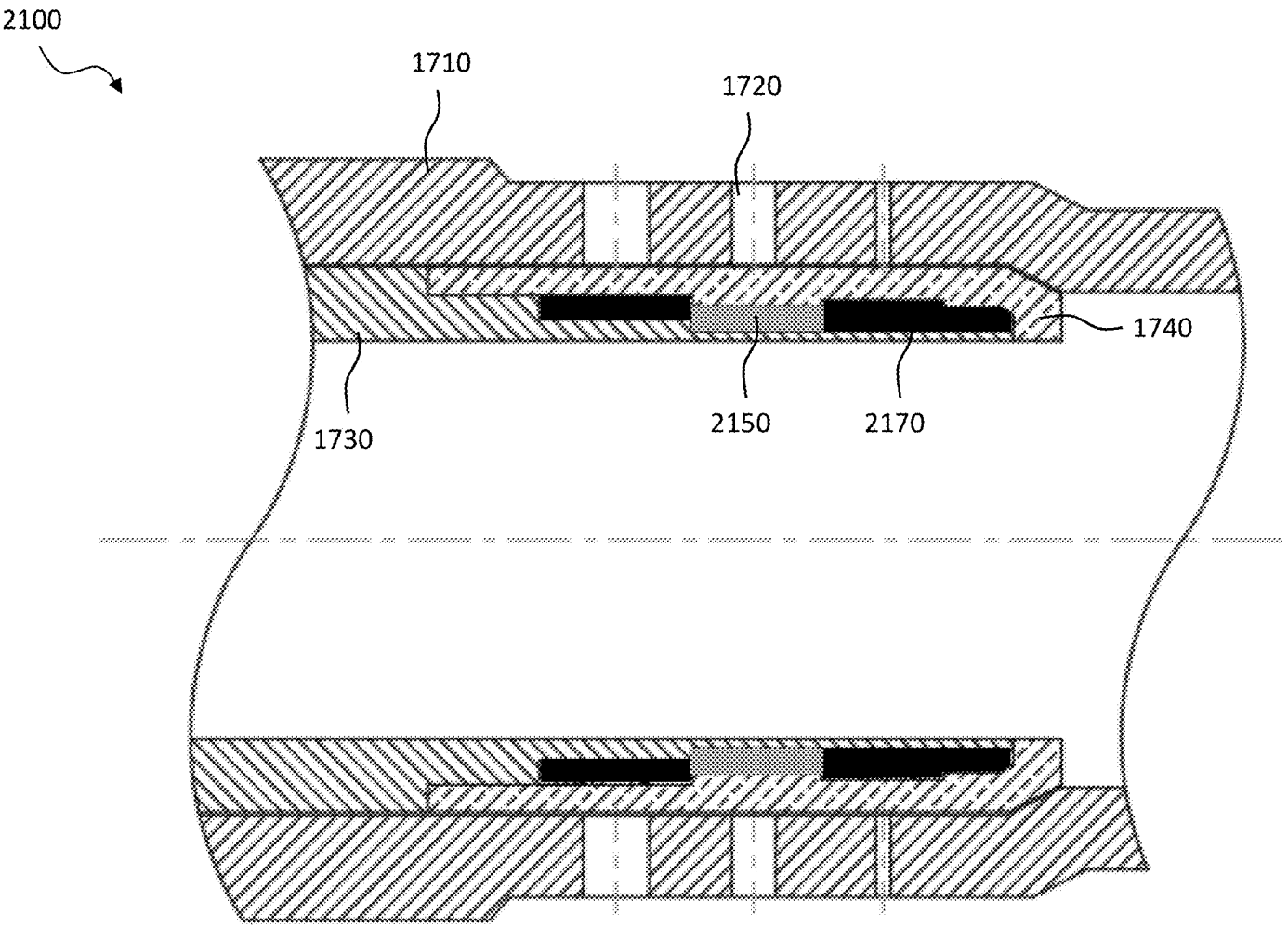

Turning now to FIG. 21, depicted is an interval control valve 2100 designed, manufactured and operated according to an alternative embodiment of the disclosure. The interval control valve 2100 of FIG. 21 is similar in many respects to the interval control valve 1900 of FIG. 19. Accordingly, like reference numbers have been used to illustrate similar, if not identical, features. The interval control valve 2100 of FIG. 21 differs from the interval control valve 1900 of FIG. 19, in that it includes two or more elastomeric sealing member 2170 on both sides of the expanded metal joint 2150.

Figure 22:
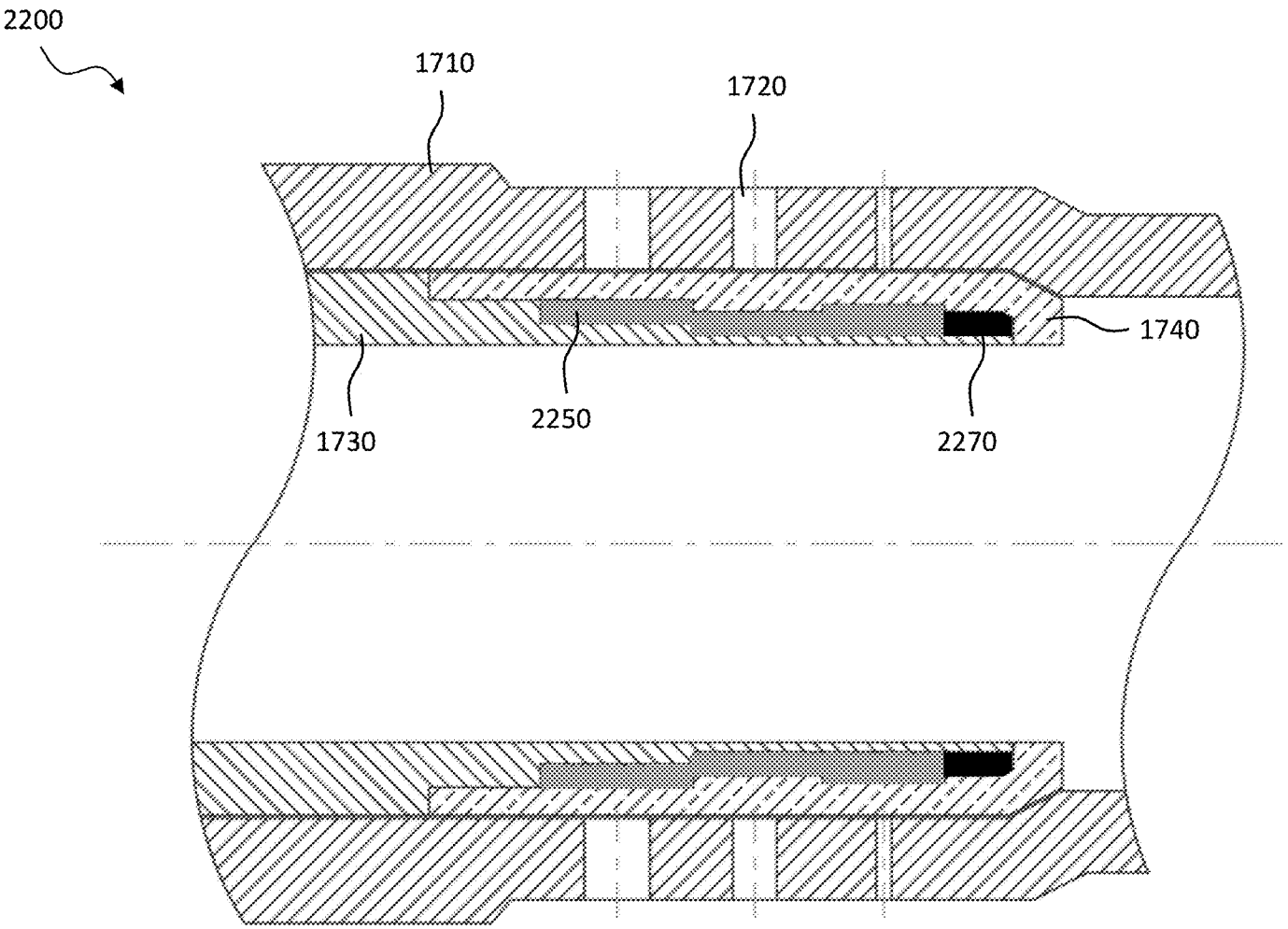

Turning now to FIG. 22, depicted is an interval control valve 2200 designed, manufactured and operated according to an alternative embodiment of the disclosure. The interval control valve 2200 of FIG. 22 is similar in many respects to the interval control valve 1900 of FIG. 19. Accordingly, like reference numbers have been used to illustrate similar, if not identical, features. The interval control valve 2200 of FIG. 22 differs from the interval control valve 1900 of FIG. 19, in that it includes an elastomeric sealing member 2270 at a tip of the multi-step expanded metal joint 2250.

Welds and/or braze are commonly used in downhole tools to connect two materials or geometries. Welds and/or braze are particularly useful in applications wherein threads do not work, for instance in non-round geometries. One such use of welds and/or braze is in multilateral junctions, and more particularly when connecting a wellbore leg (e.g., mainbore leg or lateral bore leg) with a y-block.

Figure 23:
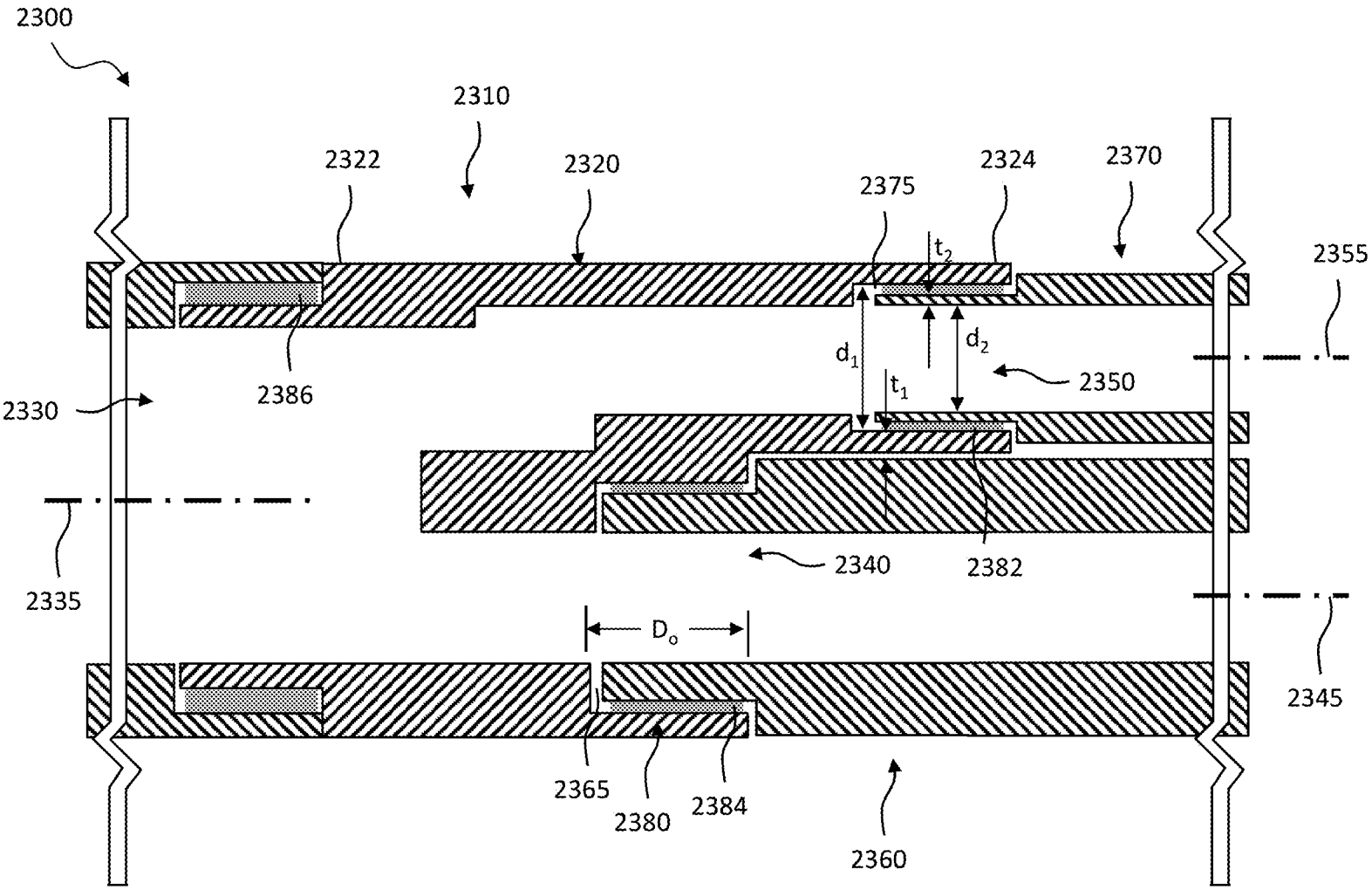
FIGS. 23 through 26 illustrate various different embodiments for multilateral junctions designed, manufactured and operated according to one or more embodiments of the disclosure.

Turning to FIG. 23, illustrated is a multilateral junction 2300 designed, manufactured and operated according to one or more embodiments of the disclosure. The multilateral junction 2300 includes a y-block 2310. In accordance with one or more embodiments of the disclosure, the y-block 2310 includes a housing 2320 having a first end 2322 and a second opposing end 2324. The housing 2320, without limitation, may comprise steel or another suitable material.

Extending into the housing 2320 from the first end 2322 is a single first bore 2330. The single first bore 2330, in accordance with one embodiment, defines a first centerline 2335. The y-block 2310 additionally includes second and third separate bores 2340, 2350, respectively, extending into the housing 2320 and branching off from the single first bore 2330. In accordance with one or more embodiments, the second bore 2340 defines a second centerline 2345, and the third bore 2350 defining a third centerline 2355.

The multilateral junction 2300, as illustrated in FIG. 23, additionally includes a mainbore leg 2360 coupled to the second bore 2340 for extending into the main wellbore. In at least one embodiment, the mainbore leg 2360 and the second bore 2340 define a second overlapping space 2365. The multilateral junction 2300, as illustrated in FIG. 23, additionally includes a lateral bore leg 2370 coupled to the third bore 2350 for extending into the lateral wellbore. In at least one embodiment, the lateral bore leg 2370 and the third bore 2350 define a third overlapping space 2375. In at least one embodiment, one or both of the lateral bore leg 2370 or the main bore leg 2360 is an approximately D-shaped tube.

In the illustrated embodiment, the third bore 2350 has a first wall thickness ($t_1$) proximate the overlapping space 2375, and the lateral bore leg 2370 has a second wall thickness ($t_2$) proximate the overlapping space. In accordance with at least one embodiment, the first wall thickness ($t_1$) and the second wall thickness ($t_2$) are no more than 5.0 cm. Nevertheless, in at least one other embodiment, the first wall thickness ($t_1$) and the second wall thickness ($t_2$) are no more than 1.25 cm. Nevertheless, in at least yet another embodiment, the first wall thickness ($t_1$) and the second wall thickness ($t_2$) are between about 0.15 cm and about 0.635 cm. Nevertheless, in at least yet another embodiment, the first wall thickness ($t_1$) and the second wall thickness ($t_2$) are no more than 0.7 cm. Thus, in accordance with the embodiment shown, the third bore 2350 and the lateral bore leg 2370 are thin walled structures. In certain embodiments, the first wall thickness ($t_1$) and the second wall thickness ($t_2$) may vary along their circumferences, for example when the mainbore leg 2360 or the lateral bore leg 2370 are not circular tubes with concentric inner and outer walls (e.g., D-shaped tubes, double-barrel D-shaped tubes, etc.).

In the illustrated embodiment, the third bore 2350 has a first inside diameter ($d_1$) proximate the overlapping space 2375 and the lateral bore leg 2370 has a second inside diameter ($d_2$) proximate the overlapping space 2375. In the illustrated embodiment, the overlapping space 2375 (and thus the resulting expanded metal joint) is positioned proximate an end of the third bore 2350 or lateral bore leg 2370. In accordance with at least one embodiment, the overlapping space (and thus the resulting expanded metal joint) is positioned less than a distance ($D_p$) from the end of the third bore 2350 or lateral bore leg 2370. The distance ($D_p$), in one or more embodiments, is equal to or less than four times the first inside diameter ($d_1$). The distance ($D_p$), in one or more other embodiments, is equal to or less than two times the first inside diameter ($d_1$).

In the illustrated embodiment, the third bore 2350 or lateral bore leg 2370 overlap by a distance ($D_o$). In at least one embodiment, the overlap distance ($D_o$) between the third bore 2350 and lateral bore leg 2370 is less than 120 cm. In yet another embodiment, the overlap distance ($D_o$) between the third bore 2350 and lateral bore leg 2370 is less than 40 cm. In yet another embodiment, the overlap distance ($D_o$) between the third bore 2350 and the lateral leg bore 2370 is less than 10 cm. Essentially, as the third bore 2350 or lateral bore leg 2370 are thin walled structures in the embodiments of FIG. 23, and thus the overlap distance ($D_o$) may not be significant.

The multilateral junction 2300, in one or more embodiments, additionally includes an expanded metal joint 2380 located in at least a portion of the second overlapping space 2365 or the third overlapping space 2375. In accordance with the disclosure, the expanded metal joint 2380 comprising a metal that has expanded in response to hydrolysis, as discussed above. In at least one embodiment, the expanded metal joint 2380 is a lateral wellbore leg expanded metal joint 2382 located in at least a portion of the third overlapping space 2375. In yet another embodiment, the expanded metal joint 2380 is a main wellbore leg expanded metal joint 2384 located in at least a portion of the second overlapping space 2365. In yet another embodiment, both the lateral wellbore leg expanded metal joint 2382 and the main wellbore leg expanded metal joint 2384 exist.

The multilateral junction 2300, in one or more embodiments, additionally includes an expanded metal joint 2386 located in at least a portion of the single first bore 2330. For example, the expanded metal joint 2386 may be used to couple an additional tubular to the single first bore 2330. In accordance with the disclosure, the expanded metal joint 2386 comprising a metal that has expanded in response to hydrolysis, as discussed above.

In the illustrated embodiment, the expanded metal joint 2380 generally fills the overlapping space 2365, 2375, as that term is defined above. In yet other embodiments, the expanded metal joint 2380 substantially fills the overlapping space 2365, 2375, as that term is defined above, or in yet other embodiments, the expanded metal joint 2380 excessively fills the overlapping space 2365, 2375, as that term is defined above.

Notwithstanding the foregoing, the expanded metal joint 2380 may have a variety of different volumes and remain within the scope of the disclosure. Such volumes, as expected, are a function of the size of the overlapping space 2365, 2375, the volume of the pre-expansion joint, and the composition of the pre-expansion joint, among other factors. Nevertheless, in at least one embodiment, the expanded metal joint 2380 has a volume of no more than 25,000 $cm^3$. In yet another embodiment, the overlapping space has a volume of no more than 7,750 $cm^3$. In at least one other embodiment, the expanded metal joint 2380 has a volume ranging from about 31.5 $mm^3$ to about 5,813 $cm^3$, and in yet another embodiment, the expanded metal joint 2380 has a volume ranging from about 4,282 $mm^3$ to about 96,700 $mm^3$.

The junctions illustrated in FIG. 23 include a single step expanded metal joint. However, other embodiments may exist wherein a different shape of junction, and thus expanded metal joint, is used. For example, any one of the junctions, and thus expanded metal joints, illustrated and described with regard to FIGS. 2A through 16C could be used with the multilateral junction 2300 and remain within the scope of the disclosure. In at least one embodiment, the multilateral junction 2300 employs a junction similar to the junction of FIGS. 9A through 9G, and thus includes a locking feature.

In one or more other embodiments, the single first bore 2330, the second bore 2340, and the third bore 2350 may each include one or more separate bores, and thus may each coupled to one or more separate tubulars. Accordingly, if any one of the single first bore 2330, the second bore 2340, and the third bore 2350 include multiple bores, each of the multiple bores could include the aforementioned expanded metal joints 2380. Furthermore, not all of the single first bore 2330, the second bore 2340, or the third bore 2350 need include the aforementioned expanded metal joints 2380.

It should also be noted that in certain other embodiments, the expanded metal joints 2380 may be located in other portions of the multilateral junction 2300. For instance, a seal stinger could be coupled at the end of the mainbore leg 2360. In this embodiment, the expanded metal joint 2380 may be used to couple the mainbore leg 2360 and the seal stinger. In another embodiment, a transition cross-over (e.g., D to round transition cross-over) could be coupled at the end of the lateral bore leg 2370. In this embodiment, the expanded metal joint 2380 may be used to couple the lateral bore leg 2370 to the transition cross-over.

Figure 24:
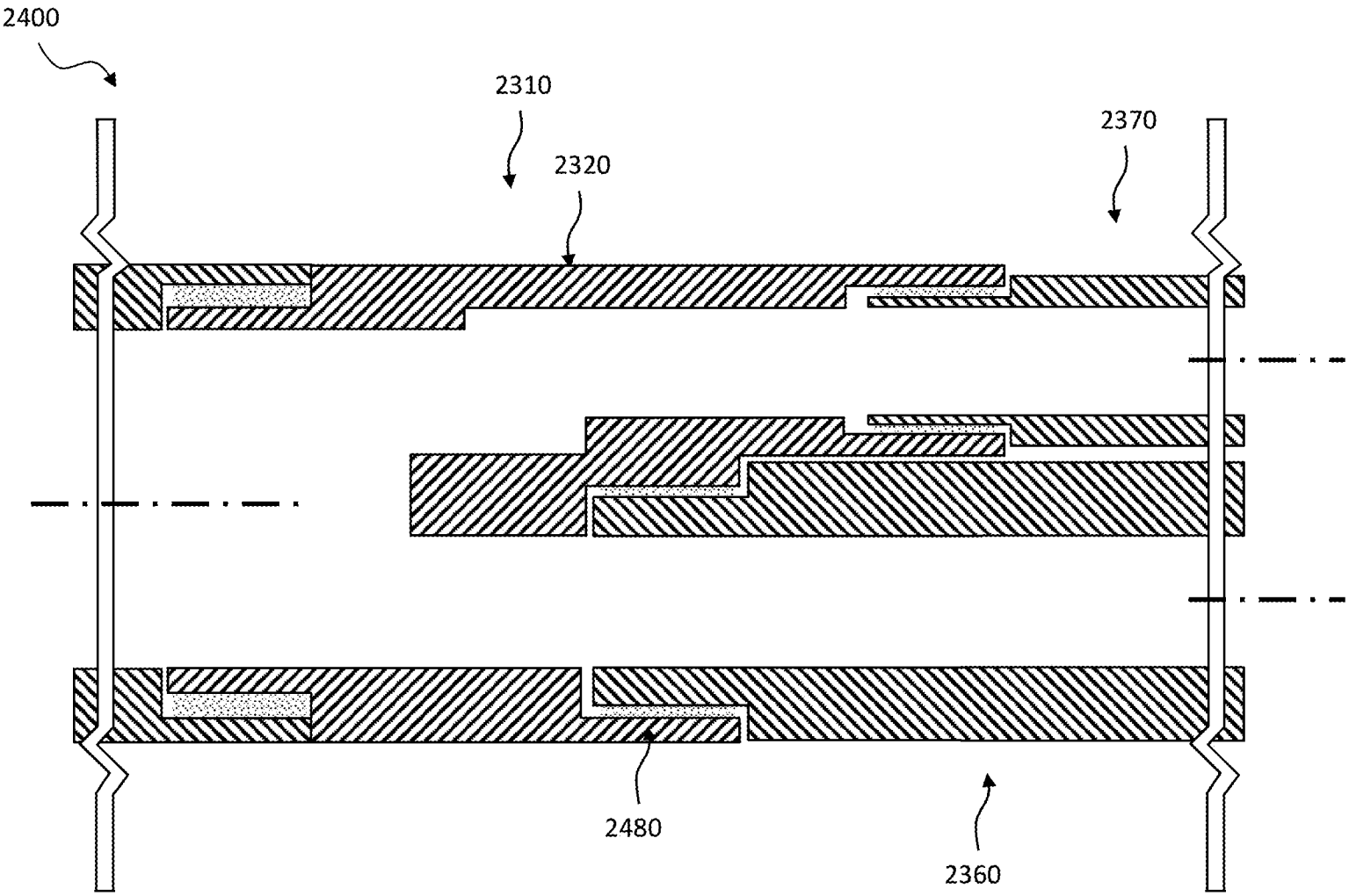

Turning now to FIG. 24, depicted is multilateral junction 2400 designed, manufactured and operated according to an alternative embodiment of the disclosure. The multilateral junction 2400 of FIG. 24 is similar in many respects to the multilateral junction 2300 of FIG. 23. Accordingly, like reference numbers have been used to illustrate similar, if not identical, features. The multilateral junction 2400 of FIG. 24 differs from the multilateral junction 2300 of FIG. 23, in that it includes an expanded metal joint 2480 having residual unreacted expandable metal therein, as further described above.

Figure 25:
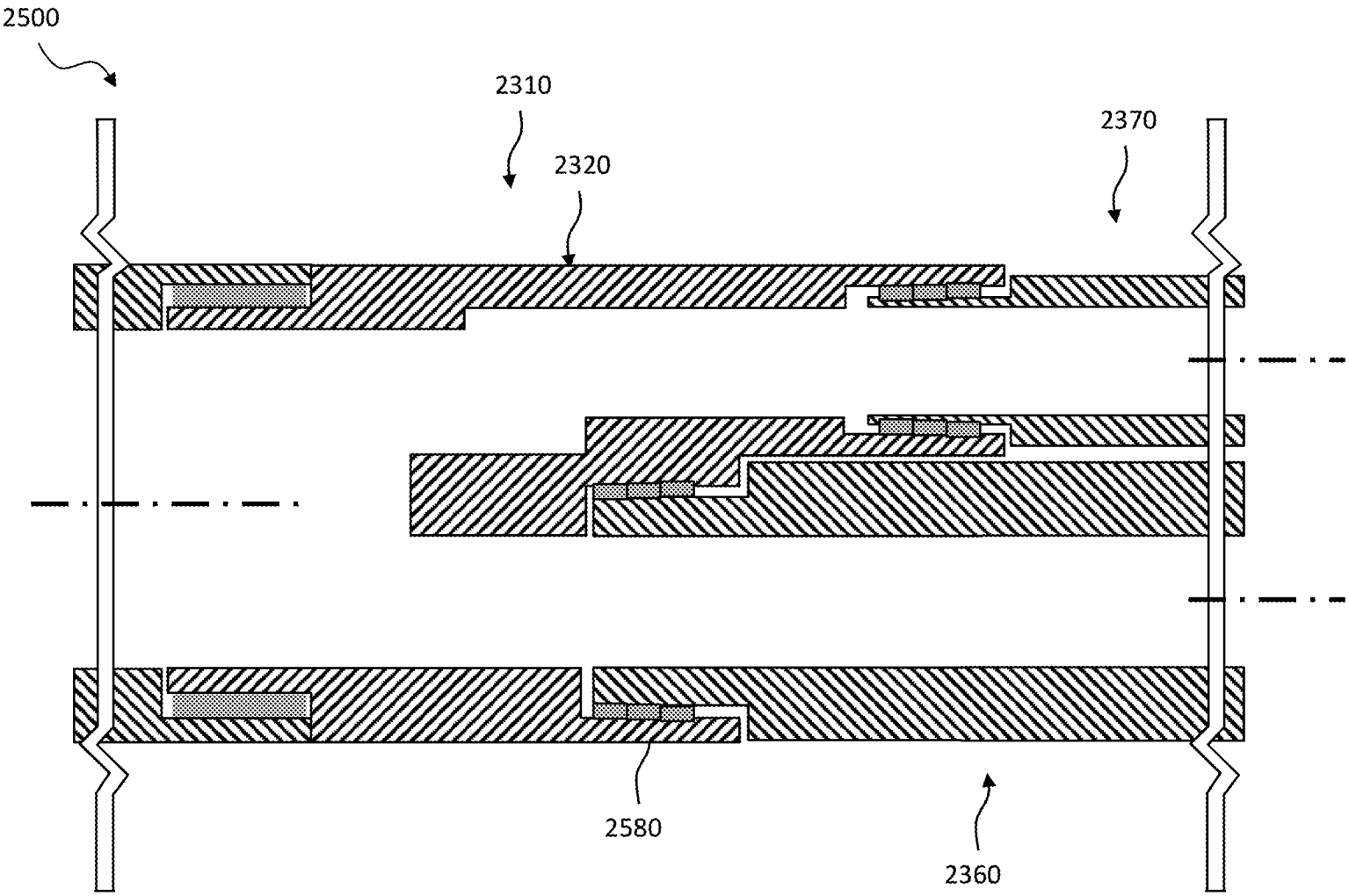

Turning now to FIG. 25, depicted is multilateral junction 2500 designed, manufactured and operated according to an alternative embodiment of the disclosure. The multilateral junction 2500 of FIG. 25 is similar in many respects to the multilateral junction 2300 of FIG. 23. Accordingly, like reference numbers have been used to illustrate similar, if not identical, features. The multilateral junction 2500 of FIG. 25 differs from the multilateral junction 2300 of FIG. 23, in that it includes a multi-step expanded metal joint 2580, as further described above. Accordingly, the multi-step expanded metal joint 2580 includes a first expanded metal joint and a second expanded metal joint, for example both comprising the metal that has expanded in response to hydrolysis.

Figure 26:
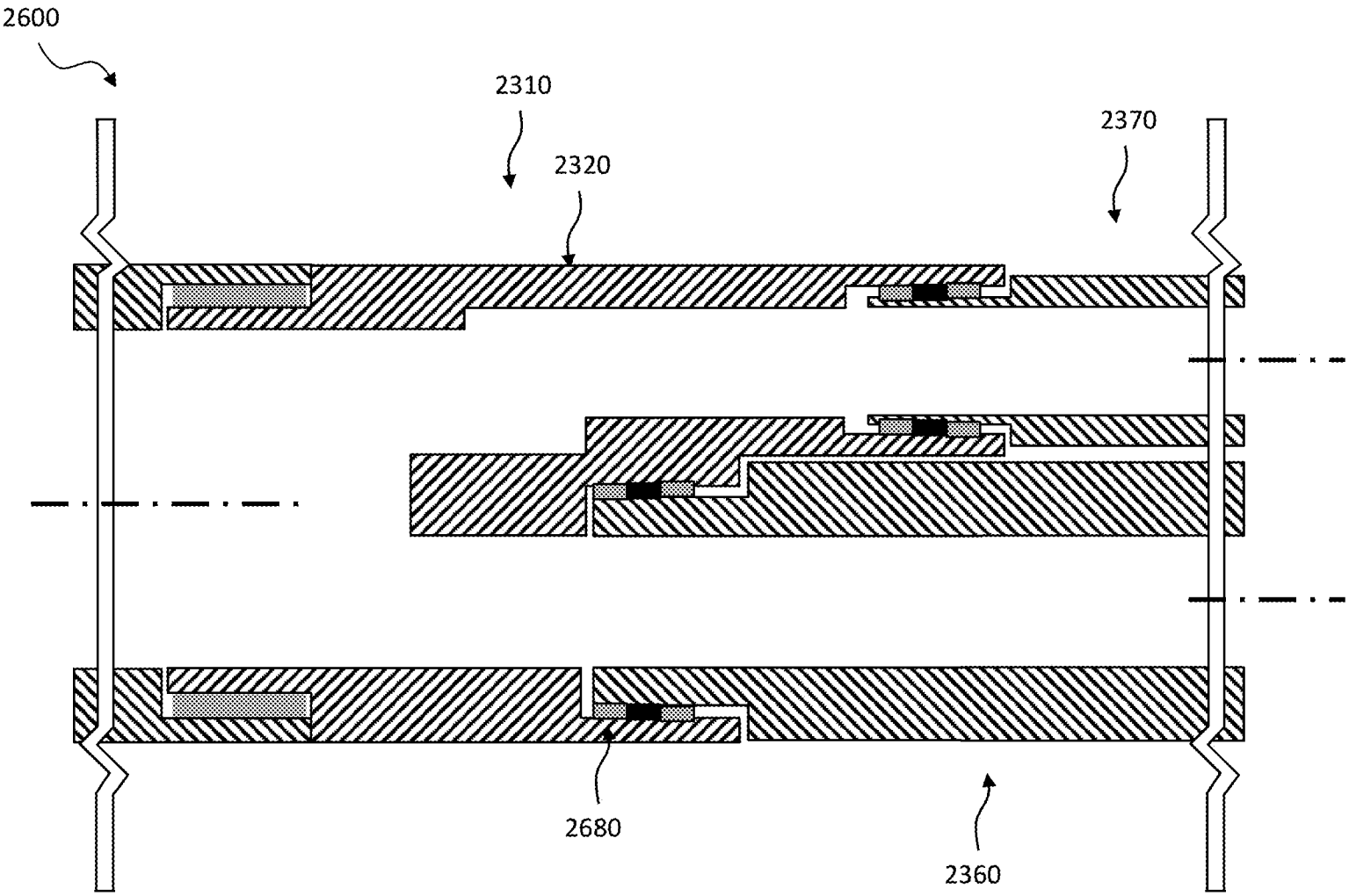

Turning now to FIG. 26, depicted is multilateral junction 2600 designed, manufactured and operated according to an alternative embodiment of the disclosure. The multilateral junction 2600 of FIG. 26 is similar in many respects to the multilateral junction 2500 of FIG. 25. Accordingly, like reference numbers have been used to illustrate similar, if not identical, features. The multilateral junction 2600 of FIG. 26 differs from the multilateral junction 2500 of FIG. 25, in that it includes an elastomeric sealing member 2670 positioned between the first expanded metal joint and the second expanded metal joint, as further described above.

Aspects disclosed herein include: [to be completed after approval of the claims by MA]

A. A junction, the junction including: 1) a first member, the first member formed of a first material; 2) a second member overlapping with the first member, the second member formed of a second material, the first and second members defining an overlapping space; and 3) an expanded metal joint located in at least a portion of the overlapping space, the expanded metal joint comprising a metal that has expanded in response to hydrolysis.

B. A method for forming a junction, the method including: 1) overlapping a first member formed of a first material with a second member formed of a second material to define an overlapping space, the overlapping space having a pre-expansion joint located at least partially therein, the pre-expansion joint comprising a metal configured to expand in response to hydrolysis; and 2) subjecting the pre-expansion joint to an activation fluid to expand the metal in the overlapping space and thereby form an expanded metal join C. An interval control valve, the interval control valve including: 1) a tubular housing, the tubular housing having one or more openings extending there through; 2) a sliding sleeve positioned within the tubular, the sliding sleeve configured to move between a closed position closing a fluid path between the one or more opening and an interior of the tubular housing, and an open position opening the fluid path between the one or more openings and the interior of the tubular housing; 3) a tubular overlapping with the sliding sleeve, the sliding sleeve and the tubular defining an overlapping space; and 4) an expanded metal joint located in at least a portion of the overlapping space, the expanded metal joint comprising a metal that has expanded in response to hydrolysis.

D. A method for deploying an interval control valve, the method including: 1) overlapping a sliding sleeve and a tubular to define an overlapping space, the overlapping space having a pre-expansion joint located at least partially therein, the pre-expansion joint comprising a metal configured to expand in response to hydrolysis; and 2) subjecting the pre-expansion joint to an activation fluid to expand the metal in the overlapping space and thereby form an expanded metal joint.

E. A well system, the well system including: 1) a wellbore; 2) production tubing positioned within the wellbore; and 3) an interval control valve coupled with the production tubing, the interval control valve including: a) a tubular housing, the tubular housing having one or more openings extending there through; b) a sliding sleeve positioned within the tubular housing, the sliding sleeve configured to move between a closed position closing a fluid path between the one or more opening and an interior of the tubular housing, and an open position opening the fluid path between the one or more openings and the interior of the tubular housing; c) a tubular overlapping with the sliding sleeve, the sliding sleeve and the tubular defining an overlapping space; and d) an expanded metal joint located in at least a portion of the overlapping space, the expanded metal joint comprising a metal that has expanded in response to hydrolysis.

F. A multilateral junction, the multilateral junction including: 1) a y-block, the y-block including; a) a housing having a first end and a second opposing end; b) a single first bore extending into the housing from the first end, the single first bore defining a first centerline; and c) second and third separate bores extending into the housing and branching off from the single first bore, the second bore defining a second centerline and the third bore defining a third centerline; 2) a mainbore leg coupled to the second bore for extending into the main wellbore, the mainbore leg and the second bore defining a second overlapping space; 3) a lateral bore leg coupled to the third bore for extending into the lateral wellbore, the lateral bore leg and the third bore defining a third overlapping space; and 4) an expanded metal joint located in at least a portion of the second overlapping space or the third overlapping space, the expanded metal joint comprising a metal that has expanded in response to hydrolysis.

G. A method for deploying a multilateral junction, the method including: 1) providing a y-block, the y-block including; a) a housing having a first end and a second opposing end; b) a single first bore extending into the housing from the first end, the single first bore defining a first centerline; and c) second and third separate bores extending into the housing and branching off from the single first bore, the second bore defining a second centerline and the third bore defining a third centerline; 2) attaching a mainbore leg to the second bore for extending into the main wellbore, the mainbore leg and the second bore defining a second overlapping space; 3) attaching a lateral bore leg to the third bore for extending into the lateral wellbore, the lateral bore leg and the third bore defining a third overlapping space, and further wherein the third overlapping space has a lateral wellbore leg pre-expansion joint located at least partially therein, the lateral wellbore leg pre-expansion joint comprising a metal configured to expand in response to hydrolysis; and 4) subjecting the lateral wellbore leg pre-expansion joint to an activation fluid to expand the metal in the third overlapping space and thereby form a lateral wellbore leg expanded metal joint in the third overlapping space.

H. A well system, the well system including: 1) a wellbore; 2) production tubing positioned within the wellbore; 3) a multilateral junction, the multilateral junction including; a) a y-block, the y-block including; b) a housing having a first end and a second opposing end; c) a single first bore extending into the housing from the first end, the single first bore defining a first centerline; and d) second and third separate bores extending into the housing and branching off from the single first bore, the second bore defining a second centerline and the third bore defining a third centerline; 4) a mainbore leg coupled to the second bore for extending into the main wellbore, the mainbore leg and the second bore defining a second overlapping space; 5) a lateral bore leg coupled to the third bore for extending into the lateral wellbore, the lateral bore leg and the third bore defining a third overlapping space; and 6) an expanded metal joint located in at least a portion of the second overlapping space or the third overlapping space, the expanded metal joint comprising a metal that has expanded in response to hydrolysis.

Aspects A, B, C, D, E, F, G and H may have one or more of the following additional elements in combination: Element 1: wherein the expanded metal joint generally fills the overlapping space. Element 2: wherein the expanded metal joint substantially fills the overlapping space. Element 3: wherein the expanded metal joint excessively fills the overlapping space. Element 4: wherein the expanded metal joint has a volume of no more than 25,000 $cm^3$. Element 5: wherein the expanded metal joint has a volume ranging from about 31.5 $mm^3$ to about 5,813 $cm^3$. Element 6: wherein the expanded metal joint has a volume ranging from about 4,282 $mm^3$ to about 96,700 $mm^3$. Element 7: wherein the first member and the second member are a first tubular and a second tubular. Element 8: wherein the first tubular has a first wall thickness ($t_1$) proximate the overlapping space and the second tubular has a second wall thickness ($t_2$) proximate the overlapping space, and further wherein the first wall thickness ($t_1$) and the second wall thickness ($t_2$) are no more than 5.0 cm. Element 9: wherein the first tubular has a first wall thickness ($t_1$) proximate the overlapping space and the second tubular has a second wall thickness ($t_2$) proximate the overlapping space, and further wherein the first wall thickness ($t_1$) and the second wall thickness ($t_2$) are no more than 1.25 cm. Element 10: wherein the expanded metal joint is positioned proximate an end of the first member or second member. Element 11: wherein the first tubular has a first inside diameter ($d_1$) proximate the overlapping space and the second tubular has a second inside diameter ($d_2$) proximate the overlapping space, and further wherein the expanded metal joint is positioned less than a distance ($D_p$) from the end of the first tubular or second tubular, the distance ($D_p$) equal to or less than four times the first inside diameter ($d_1$). Element 12: wherein the first tubular has a first inside diameter ($d_1$) proximate the overlapping space and the second tubular has a second inside diameter ($d_2$) proximate the overlapping space, and further wherein the expanded metal joint is positioned less than a distance ($D_p$) from the end of the first tubular or second tubular, the distance ($D_p$) equal to or less than two times the first inside diameter ($d_1$). Element 13: wherein an overlap distance ($D_o$) between the first member and the second member is less than 120 cm. Element 14: wherein an overlap distance ($D_o$) between the first member and the second member is less than 10 cm. Element 15: wherein the expanded metal joint is a first expanded metal joint, and further including a second expanded metal joint located in at least a portion of the overlapping space, the second expanded metal joint comprising the metal that has expanded in response to hydrolysis. Element 16: further including an elastomeric sealing member positioned between the first expanded metal joint and the second expanded metal joint. Element 17: further including an elastomeric sealing member positioned in the overlapping space. Element 18: wherein the first member has a length ($L_1$) and the second member has a length ($L_2$), and further wherein at least a portion of the expanded metal joint is parallel with the length ($L_1$). Element 19: wherein at least a portion of the expanded metal joint is angled relative to the length ($L_1$). Element 20: wherein the first member has a length ($L_1$) and the second member has a length ($L_2$), and further wherein at least a portion of the expanded metal joint is angled relative to the length ($L_1$). Element 21: wherein the expanded metal joint includes residual unreacted expandable metal therein. Element 22: wherein the expanded metal joint is a single step expanded metal joint. Element 23: wherein the expanded metal joint is a multi-step expanded metal joint. Element 24: wherein the expanded metal joint is a butt joint. Element 25: wherein the expanded metal joint is a tongue and groove joint. Element 26: wherein the first member has a groove and the second member has a threaded tongue. Element 27: wherein the second member has threads an outside diameter of its threaded tongue. Element 28: wherein the first member has associated threads on an outside diameter of its grove. Element 29: wherein the expanded metal joint includes a snap ring locking feature. Element 30: wherein the expanded metal joint is a face joint. Element 31: wherein the expanded metal joint is an expanded metal plug joint. Element 32: wherein the first material and the second material are different materials. Element 33: wherein the expanded metal joint substantially fills the overlapping space. Element 34: wherein the expanded metal joint has a volume of no more than 25,000 $cm^3$. Element 35: wherein the first member and the second member are a first tubular and a second tubular, the first tubular having a first wall thickness ($t_1$) proximate the overlapping space and the second tubular having a second wall thickness ($t_2$) proximate the overlapping space, and further wherein the first wall thickness ($t_1$) and the second wall thickness ($t_2$) are no more than 5.0 cm. Element 36: wherein the first tubular has a first inside diameter ($d_1$) proximate the overlapping space and the second tubular has a second inside diameter ($d_2$) proximate the overlapping space, and further wherein the expanded metal joint is positioned less than a distance ($D_p$) from the end of the first tubular or second tubular, the distance ($D_p$) equal to or less than four times the first inside diameter ($d_1$). Element 37: wherein an overlap distance ($D_o$) between the first member and the second member is less than 10 cm. Element 38: wherein the tubular is an abrasion resistant tip. Element 39: wherein the tubular is a carbide abrasion resistant tip. Element 40: wherein the expanded metal joint substantially fills the overlapping space. Element 41: wherein the expanded metal joint has a volume ranging from about 31.5 $mm^3$ to about 5,813 $cm^3$. Element 42: wherein the sliding sleeve has a first wall thickness ($t_1$) proximate the overlapping space and the tubular has a second wall thickness ($t_2$) proximate the overlapping space, and further wherein the first wall thickness ($t_1$) and the second wall thickness ($t_2$) are no more than 5 cm. Element 43: wherein the sliding sleeve has a first inside diameter ($d_1$) proximate the overlapping space and the tubular has a second inside diameter ($d_2$) proximate the overlapping space, and further wherein the expanded metal joint is positioned less than a distance ($D_p$) from the end of the first member or second member, the distance ($D_p$) equal to or less than four times the first inside diameter ($d_1$). Element 44: wherein an overlap distance ($D_o$) between the sliding sleeve and the tubular is less than 40 cm. Element 45: wherein the expanded metal joint is a first expanded metal joint, and further including a second expanded metal joint located in at least a portion of the overlapping space, the second expanded metal joint comprising the metal that has expanded in response to hydrolysis. Element 46: further including an elastomeric sealing member positioned between the first expanded metal joint and the second expanded metal joint. Element 47: wherein the expanded metal joint includes residual unreacted expandable metal therein. Element 48: wherein the expanded metal joint is a single step expanded metal joint. Element 49: wherein the expanded metal joint is a multi-step expanded metal joint. Element 50: wherein the sliding sleeve and the tubular comprise different materials. Element 51: further including positioning the sliding sleeve and the tubular having the expanded metal joint within a tubular housing having one or more openings extending there through. Element 52: wherein the subjecting occurs at or about ground level. Element 53: further including an elastomeric sealing member positioned in the overlapping space. Element 54: wherein the expanded metal joint includes residual unreacted expandable metal therein. Element 55: wherein the expanded metal joint is a multi-step expanded metal joint. Element 56: wherein the expanded metal joint is a lateral wellbore leg expanded metal joint located in at least a portion of the third overlapping space. Element 57: wherein the lateral bore leg is a D-shaped tube. Element 58: further including a main wellbore leg expanded metal joint located in at least a portion of the second overlapping space, the main wellbore leg expanded metal joint comprising the metal that has expanded in response to hydrolysis. Element 59: wherein the third bore has a first wall thickness ($t_1$) proximate the third overlapping space and the lateral wellbore leg has a second wall thickness ($t_2$) proximate the third overlapping space, and further wherein the first wall thickness ($t_1$) and the second wall thickness ($t_2$) are no more than 5.0 cm. Element 60: wherein the lateral wellbore leg expanded metal joint is a first lateral wellbore leg expanded metal joint, and further including a second lateral wellbore leg expanded metal joint located in at least a portion of the third overlapping space, the second lateral wellbore leg expanded metal joint comprising the metal that has expanded in response to hydrolysis. Element 61: further including an elastomeric sealing member positioned between the first lateral wellbore expanded metal joint and the second lateral wellbore expanded metal joint. Element 62: wherein the third bore has a first inside diameter ($d_1$) proximate the third overlapping space and the lateral wellbore leg has a second inside diameter ($d_2$) proximate the third overlapping space, and further wherein the lateral wellbore leg expanded metal joint is positioned less than a distance ($D_p$) from the end of the third bore or lateral wellbore leg, the distance ($D_p$) equal to or less than four times the first inside diameter ($d_1$). Element 63: wherein an overlap distance ($D_o$) between the third bore and the lateral wellbore leg is less than 40 cm. Element 64: wherein the expanded metal joint includes residual unreacted expandable metal therein. Element 65: wherein the expanded metal joint is a single step expanded metal joint. Element 66: further including positioning the multilateral junction including the lateral wellbore leg expanded metal joint downhole. Element 67: wherein the lateral bore leg is a D-shaped tube. Element 68: further including a main wellbore leg expanded metal joint located in at least a portion of the second overlapping space, the main wellbore leg expanded metal joint comprising the metal that has expanded in response to hydrolysis. Element 69: wherein the third bore has a first wall thickness ($t_1$) proximate the third overlapping space and the lateral wellbore leg has a second wall thickness ($t_2$) proximate the third overlapping space, and further wherein the first wall thickness ($t_1$) and the second wall thickness ($t_2$) are no more than 5.0 cm. Element 70: wherein the lateral wellbore leg expanded metal joint is a first lateral wellbore leg expanded metal joint, and further including a second lateral wellbore leg expanded metal joint located in at least a portion of the third overlapping space, the second lateral wellbore leg expanded metal joint comprising the metal that has expanded in response to hydrolysis. Element 71: further including an elastomeric sealing member positioned between the first lateral wellbore expanded metal joint and the second lateral wellbore expanded metal joint. Element 72: wherein the expanded metal joint includes residual unreacted expandable metal therein. Element 73: wherein the expanded metal joint is a single step expanded metal joint. Element 74: wherein the expanded metal joint is a lateral wellbore leg expanded metal joint located in at least a portion of the third overlapping space.

Those skilled in the art to which this application relates will appreciate that other and further additions, deletions, substitutions and modifications may be made to the described embodiments.

What is claimed is:

1. An interval control valve, comprising: a tubular housing, the tubular housing having one or more openings extending there through; a sliding sleeve positioned within the tubular housing, the sliding sleeve configured to move between a closed position closing a fluid path between the one or more opening and an interior of the tubular housing, and an open position opening the fluid path between the one or more openings and the interior of the tubular housing; a tubular overlapping with the sliding sleeve, the sliding sleeve and the tubular defining an overlapping space; and an expanded metal joint located in at least a portion of the overlapping space, the expanded metal joint comprising a metal that has expanded in response to hydrolysis.

2. The interval control valve as recited in claim 1, wherein the tubular is an abrasion resistant tip.

3. The interval control valve as recited in claim 2, wherein the tubular is a carbide abrasion resistant tip.

4. The interval control valve as recited in claim 1, wherein the expanded metal joint substantially fills the overlapping space.

5. The interval control valve as recited in claim 1, wherein the expanded metal joint has a volume ranging from about 31.5 $mm^3$ to about 5,813 $cm^3$.

6. The interval control valve as recited in claim 1, wherein the sliding sleeve has a first wall thickness ($t_1$) proximate the overlapping space and the tubular has a second wall thickness ($t_2$) proximate the overlapping space, and further wherein the first wall thickness ($t_1$) and the second wall thickness ($t_2$) are no more than 5 cm.

7. The interval control valve as recited in claim 1, wherein the sliding sleeve has a first inside diameter ($d_1$) proximate the overlapping space and the tubular has a second inside diameter ($d_2$) proximate the overlapping space, and further wherein the expanded metal joint is positioned less than a distance ($D_p$) from the end of the first member or second member, the distance ($D_p$) equal to or less than four times the first inside diameter ($d_1$).

8. The interval control valve as recited in claim 1, wherein an overlap distance ($D_o$) between the sliding sleeve and the tubular is less than 40 cm.

9. The interval control valve as recited claim 1, wherein the expanded metal joint is a first expanded metal joint, and further including a second expanded metal joint located in at least a portion of the overlapping space, the second expanded metal joint comprising the metal that has expanded in response to hydrolysis.

10. The interval control valve as recited in claim 9, further including an elastomeric sealing member positioned between the first expanded metal joint and the second expanded metal joint.

11. The interval control valve as recited in claim 1, wherein the expanded metal joint includes residual unreacted expandable metal therein.

12. The interval control valve as recited in claim 1, wherein the expanded metal joint is a single step expanded metal joint.

13. The interval control valve as recited in claim 1, wherein the expanded metal joint is a multi-step expanded metal joint.

14. The interval control valve as recited in claim 1, wherein the sliding sleeve and the tubular comprise different materials.

15. A method for deploying an interval control valve, comprising:

overlapping a sliding sleeve and a tubular to define an overlapping space, the overlapping space having a pre-expansion joint located at least partially therein, the pre-expansion joint comprising a metal configured to expand in response to hydrolysis; and subjecting the pre-expansion joint to an activation fluid to expand the metal in the overlapping space and thereby form an expanded metal joint.

16. The method as recited in claim 15, further including positioning the sliding sleeve and the tubular having the expanded metal joint within a tubular housing having one or more openings extending there through.

17. The method as recited in claim 15, wherein the subjecting occurs at or about ground level.

18. The method as recited in claim 15, further including an elastomeric sealing member positioned in the overlapping space.

19. The method as recited in claim 15, wherein the expanded metal joint includes residual unreacted expandable metal therein.

20. The method as recited in claim 15, wherein the expanded metal joint is a multi-step expanded metal joint.

21. A well system, comprising:

a wellbore;

production tubing positioned within the wellbore; and an interval control valve coupled with the production tubing, the interval control valve including:

a tubular housing, the tubular housing having one or more openings extending there through;

a sliding sleeve positioned within the tubular housing, the sliding sleeve configured to move between a closed position closing a fluid path between the one or more opening and an interior of the tubular housing, and an open position opening the fluid path between the one or more openings and the interior of the tubular housing;

a tubular overlapping with the sliding sleeve, the sliding sleeve and the tubular defining an overlapping space; and an expanded metal joint located in at least a portion of the overlapping space, the expanded metal joint comprising a metal that has expanded in response to hydrolysis.

* * * * *